US009032560B2

(12) United States Patent
Lambert et al.

(10) Patent No.: US 9,032,560 B2
(45) Date of Patent: May 19, 2015

(54) MULTI-FLUSH MODE TOILET

(71) Applicant: Kohler Co., Kohler, WI (US)

(72) Inventors: Tony L. Lambert, Saukville, WI (US); Clayton C. Garrels, Sheboygan, WI (US); Douglas E. Bogard, Kohler, WI (US); Daniel N. Halloran, Saukville, WI (US); Randy O. Mesun, Sheyboygan, WI (US)

(73) Assignee: KOHLER CO., Kohler, WI (US)

( * ) Notice: Subject to any disclaimer, the term of this patent is extended or adjusted under 35 U.S.C. 154(b) by 167 days.

(21) Appl. No.: 13/777,772

(22) Filed: Feb. 26, 2013

(65) Prior Publication Data

US 2013/0219606 A1 Aug. 29, 2013

Related U.S. Application Data

(60) Provisional application No. 61/604,355, filed on Feb. 28, 2012.

(51) Int. Cl.
*E03D 1/14* (2006.01)
*E03D 5/02* (2006.01)

(52) U.S. Cl.
CPC . *E03D 1/142* (2013.01); *E03D 5/02* (2013.01)

(58) Field of Classification Search
USPC ..... 4/324, 325, 405, 413–415
See application file for complete search history.

(56) References Cited

U.S. PATENT DOCUMENTS

| | | | |
|---|---|---|---|
| 4,305,163 | A | 12/1981 | Raz |
| 4,748,699 | A | 6/1988 | Stevens |
| 5,301,373 | A | 4/1994 | Hull et al. |
| D356,145 | S | 3/1995 | Bollenbacher |
| 5,400,445 | A | 3/1995 | Hull |
| D367,519 | S | 2/1996 | Bengtson |
| 5,555,573 | A | 9/1996 | Jensen |
| 6,263,520 | B1 | 7/2001 | Song |
| 6,311,342 | B1 | 11/2001 | Hwang |
| 6,317,899 | B1 | 11/2001 | Brewer |
| 6,339,882 | B1 | 1/2002 | Goessling et al. |
| 6,704,945 | B2 | 3/2004 | Bellmore |
| 6,728,975 | B2 | 5/2004 | Han |

(Continued)

FOREIGN PATENT DOCUMENTS

| | | |
|---|---|---|
| CN | 2319457 | 5/1999 |
| GB | 2112037 | 7/1983 |

OTHER PUBLICATIONS

Notice of First Office Action in Chinese Application No. 201310062840.6.

*Primary Examiner* — Tuan N Nguyen

(74) *Attorney, Agent, or Firm* — Foley & Lardner LLP

(57) ABSTRACT

An actuation mechanism comprising a first handle, a second handle, a housing, a link arm member provided within the housing and pivotally coupled to the handles, and a moveable stop member provided within the housing. The first handle may be mounted to a first side of a toilet tank, and the second handle may be mounted coaxially relative to the first handle on the first side. The housing may be mounted to a second side of the tank. A rotation of one of the first and second handles results in rotation of the link arm member being limited by the moveable stop member such that the link arm member is permitted to rotate a first amount. Rotation of both the first and second handles results in movement of the moveable stop member such that the link arm member is permitted to rotate a second amount greater than the first amount.

20 Claims, 18 Drawing Sheets

(56) References Cited

U.S. PATENT DOCUMENTS

| | | | |
|---|---|---|---|
| 6,823,534 | B2 | 11/2004 | Li |
| 6,898,808 | B2 | 5/2005 | Molho et al. |
| 7,010,816 | B2 | 3/2006 | Li |
| 7,062,801 | B2 | 6/2006 | Oliver |
| 7,159,251 | B2 | 1/2007 | Hennessy |
| 7,219,375 | B2 | 5/2007 | Steadman |
| 7,810,178 | B2 | 10/2010 | Wajda |
| 7,996,928 | B2 | 8/2011 | Lorenz |
| 2006/0026745 | A1 | 2/2006 | Heath |
| 2008/0295238 | A1 | 12/2008 | Hawley et al. |
| 2009/0307833 | A1 | 12/2009 | Ciski et al. |
| 2010/0132104 | A1 | 6/2010 | Csiki |
| 2011/0094022 | A1 | 4/2011 | Li |
| 2011/0167549 | A1 | 7/2011 | Schuster et al. |
| 2011/0167550 | A1 | 7/2011 | Revelle |

MULTI-FLUSH MODE TOILET

CROSS-REFERENCE TO RELATED PATENT APPLICATIONS

This application claims the benefit of and priority to U.S. Provisional Patent Application No. 61/604,355, which was filed on Feb. 28, 2012. The foregoing U.S. provisional application is incorporated herein by reference in its entirety.

BACKGROUND

The present application relates generally to the field of toilets having flush valves to regulate the flow of water from the toilet tank to the toilet bowl and having actuators for controlling the operation of the flush valves. More specifically, the present application relates to a toilet having an improved multi-mode flush valve to regulate the flow of water from the tank to the bowl, where the operation of the flush valve is controlled by an improved multi-mode flush valve actuator.

SUMMARY

One embodiment relates to an actuation mechanism for a dual flush toilet assembly. The actuation mechanism comprising a first handle, a second handle, a housing, a link arm member, and a moveable stop member provided within the housing. The first handle is configured to be mounted to a first side of a toilet tank, and the second handle is mounted coaxially relative to the first handle and configured to be mounted to the first side of the toilet tank. The housing is configured to be mounted to a second side of the toilet tank. The link arm member is provided within the housing and pivotally coupled to the first and second handles. A rotation of one of the first handle and the second handle results in rotation of the link arm member being limited by the moveable stop member such that the link arm member is permitted to rotate a first amount to provide a partial flush for the toilet assembly. Rotation of both the first handle and the second handle results in movement of the moveable stop member such that the link arm member is permitted to rotate a second amount greater than the first amount to provide a full flush for the toilet assembly.

The link arm member may include a first link arm member coupled to the second handle and a second link arm member coupled to the first handle, and wherein the first and second link arm members are mounted coaxially. The actuation mechanism may also include a drive member configured to move the stop member upon rotation of the second handle, and where rotation of only the first handle results in rotation of only the second link arm member. The drive member may include a first end pivotally coupled to the first link arm member and a second end pivotally coupled to the stop member. The stop member may be configured to rotate about a pivot axis that is offset from and substantially parallel to a pivot axis of the handles.

The actuation mechanism may also include a cam that is configured to move the stop member upon rotation of the second handle, and where rotation of only the first handle results in rotation of the link arm member without rotating the cam. The cam may be provided coaxially with the second handle and driven to rotation about a pivot axis of the second handle by rotation of the second handle. The cam may include a cam surface that is disposed along a portion of an outer edge of the cam. The cam surface may be configured as a ramp surface that is configured at an angle relative to a plane that is substantially transverse to the pivot axis of the cam. The cam may be configured to rotate between a first position and a second position, wherein when the cam is in the first position, the stop member limits the rotation of the link arm by the first amount, and wherein when the cam is in the second position, the stop member permits the link arm to rotate by the second amount. The stop member may be configured to rotate about a pivot axis that is transverse to the pivot axis of the second handle and the cam. The actuation mechanism may also include a biasing member that is configured to bias the stop member in a direction that is parallel to the pivot axis of the second handle.

Another embodiment relates to an actuation mechanism for a multi-flush toilet assembly. The actuation mechanism comprises a first handle, a second handle, a moveable element, and a cam. The first handle is configured to pivot about a pivot axis, and the second handle is configured to pivot about the pivot axis. The cam is coupled to one of the first and second handles and includes a cam surface configured to move the moveable element. A rotation of the one of the first and second handles is limited to a first angular travel by the moveable element provided in a first position, the first angular travel configured to provide a first flush mode of the toilet assembly, and rotation of both the first and second handles results in movement of the moveable element to a second position which permits the first and second handles to rotate to a second angular travel to provide a second flush mode that is different than the first flush mode.

The actuation mechanism may also include a guide member configured to be fixedly mounted relative to the handles, where the guide member includes a cavity and a slot extending from the cavity. The cam may be pivotally disposed in the guide member and configured to move the moveable element, such as, for example, wherein when in the first position, the moveable element is in the slot, and wherein when in the second position, the moveable element is in the cavity. The moveable element may be configured as ball. The cam may be bi-planar including a first side and a second side, and the moveable element may include a first elongated portion configured to be driven by the first side and a second cylindrical portion configured to be driven by the second side.

The cam may be coupled to the second handle through a tubular portion that extends through a bushing, such that rotation of the second handle rotates the cam through the tubular portion. The cam may include a cam surface configured to drive movement of the moveable element upon rotation of the cam, and wherein the moveable element is configured as an elongated member configured to pivot about a pivot axis disposed at a first end. The actuation mechanism may also include a link arm coupled to the first handle through a shaft that extends in a bore of the tubular portion, such that rotation of the first handle rotates the link arm through the shaft.

Yet another embodiment relates to an actuation mechanism for a multi-flush toilet. The actuation mechanism comprises a first handle configured to pivot about a pivot axis; a second handle configured to pivot about the pivot axis; a stop member configured to pivot between a first position and a second position; and a driving member configured to move the stop member. Pivoting of only the first handle is limited to a first rotation by the stop member configured in the first position, and pivoting of the second handle rotates the first handle with the second handle and moves the stop member to the second position through the driving member allowing the first and second handles to pivot to a second rotation that is greater than the first rotation. When the first handle is pivoted by the first rotation, the actuation mechanism actuates a first flush cycle of the toilet that is configured to transfer a first volume of water from a tank to a bowl. When both of the handles are pivoted by the second rotation, the actuation mechanism actuates a second flush cycle that is configured to transfer a second volume of water from the tank to the bowl, the second volume being greater than the first volume.

The driving member may be a cam that is configured to rotate about the pivot axis, the cam including a cam surface that is configured to rotate the stop member between the first and second positions about a rotational axis that extends transverse to the pivot axis.

The driving member may include a longitudinal extension and an arm that extends outwardly from the extension, wherein the extension couples the driving member to the second handle, and wherein the arm is configured to drive the stop member and includes an attachment feature for attaching a connecting element that actuates a valve assembly configured to control the first and second flush cycles.

The actuation mechanism may also include a link arm operatively coupled to the first handle and configured to rotate about the pivot axis upon rotation of the first handle, the link arm including a distal end that includes an attachment feature configured to be coupled to a connecting member that actuates a valve assembly configured to control the first and second flush cycles.

DETAILED DESCRIPTION

Referring generally to the Figures, the present application discloses toilets having improved flush valve assemblies configured to regulate (e.g., control) the flow of water, such as the volume of water, delivered from a toilet tank to a toilet bowl during a flush cycle of the toilet. The flush valve assembly is operatively coupled to the tank, such as through a seal to prohibit leaking of the water between the tank and flush valve assembly. The toilets disclosed herein may include flush valve assemblies configured to provide more than one mode of operation (e.g., dual flush modes, multi-flush modes) wherein the valves include a valve body that is configured to increase the discharge flow rate of the flush valve by utilizing a reducing cross-section in the valve body.

The toilets disclosed herein may be configured to provide multiple (e.g., two, dual) flush modes of operation, such as, for example, by providing a first (e.g., short, reduced, partial, etc.) flush mode of operation and a second (e.g., long, full, etc.) flush mode of operation. The first flush mode of operation may be configured to transfer a first (e.g., reduced) volume of water from the tank to the bowl through the flush valve assembly. The second flush mode of operation may be configured to transfer a second (e.g., full) volume of water from the tank to the bowl through the flush valve assembly. This toilet configuration may advantageously reduce overall water usage by allowing the user to select between the first and second modes of operation of the toilet. For example, the toilet may be actuated to use a reduced amount (e.g., volume) of water during a flush cycle through the first flush mode of operation, such as to flush liquid wastes from the bowl to outside the toilet (e.g., a soil pipe), and may be actuated to use a full amount (i.e., an amount greater than the reduced amount) of water during a flush cycle through the second flush mode of operation such as to flush solid and liquid wastes from the toilet.

The toilets disclosed herein may include actuator assemblies configured to control the flush modes of operation (e.g., two or dual modes of the operation) by controlling the operation of the flush valve assembly. For example, the actuator may be configured to move from a first (e.g., rest, home, etc.) position to a second position to operate the toilet in the first mode of operation, and the actuator may be configured to move from the first position to a third position to operate the toilet in the second mode of operation.

Figure 1A:
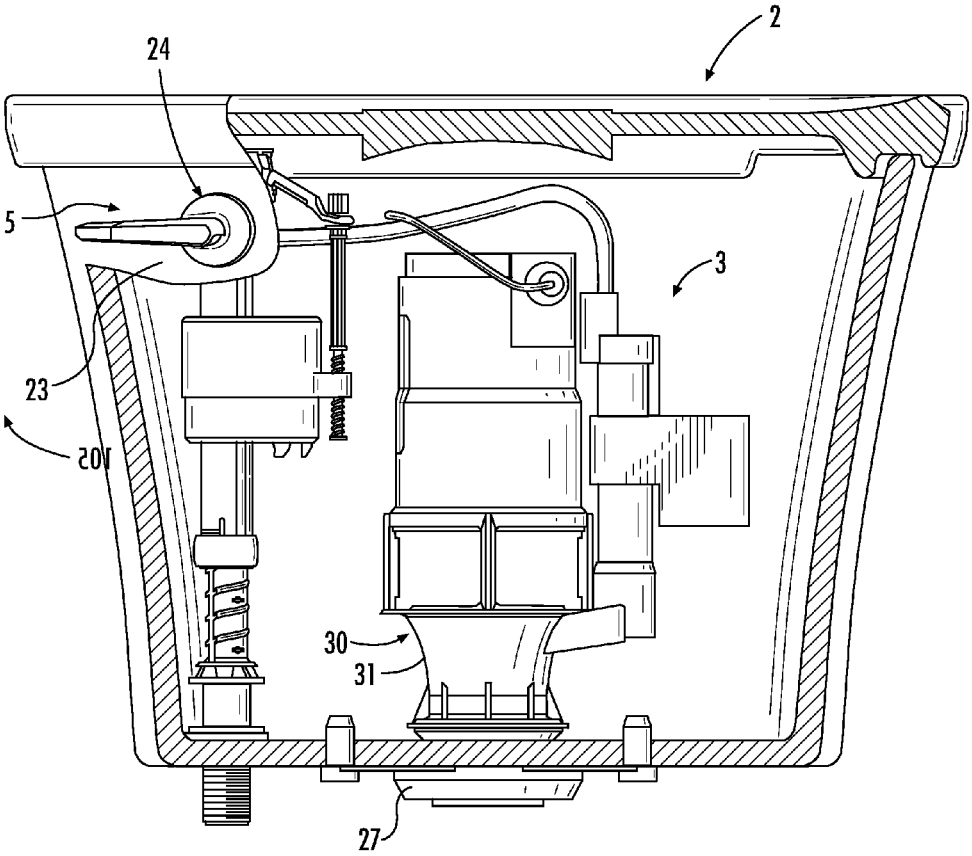
FIG. 1A is a front partial cross-sectional view of a tank and a flush valve assembly for a toilet, according to an exemplary embodiment.
Figure 1B:
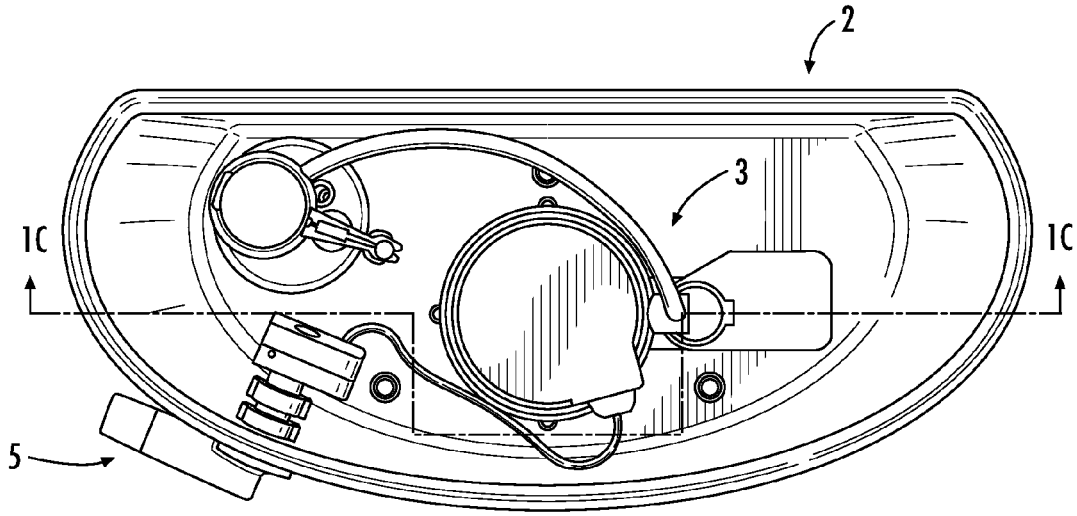
FIG. 1B is a top view of the tank and flush valve assembly of FIG. 1.
Figure 1C:
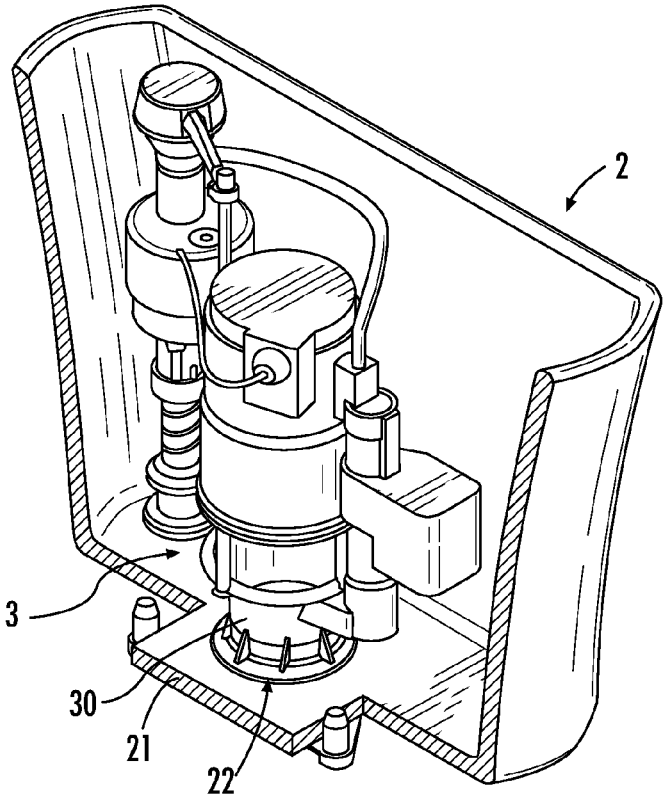
FIG. 1C is a partially cut-away perspective view of the tank and flush valve assembly of FIG. 1.

FIGS. 1A-1C illustrate an exemplary embodiment of a tank 2 for use in a toilet that is configured to hold a volume of water therein. The tank 2 includes a bottom wall 21 having an opening 22 therein to allow water to transfer from the tank 2 to a bowl (not shown) of the toilet, such as through a flush valve assembly 3. Accordingly, the flush valve assembly 3 may be coupled to the tank 2, such as the bottom wall 21, to control the amount (e.g., volume) of water transferred from the tank 2 to the bowl during a flush cycle of a toilet. The flush valve assembly 3 may be configured to operate in more than one mode of operation. For example, the flush valve assembly 3 may be configured operate in a first (e.g., reduced, short, etc.) flush mode of operation that is configured to transfer a first (e.g., reduced, less than full) volume of water from the tank 2 to the bowl and operate in a second (e.g., full) flush mode of operation that is configured to transfer a second (e.g., full, long, etc.) volume of water from the tank 2 to the bowl. The flush valve assembly 3 also has a closed mode of operation, wherein water is prohibited from passing from the tank 2 to the bowl.

As shown in FIGS. 1A and 1B, the tank 2 also includes a front wall 23 having an opening 24 therein to allow an actuator assembly 5 to be coupled to the tank 2, where the actuator assembly 5 is configured to control the flush modes of operation of the toilet by controlling the operation of the flush valve assembly 3. For example, the actuator assembly 5 may be configured to be moved from a first position corresponding to the closed mode of operation of the flush valve assembly 3 to a second position that activates the flush valve assembly 3 to operate in the first flush mode of operation. The actuator assembly 5 may also be configured to be moved from the first position to a third position that activates the flush valve assembly 3 to operate in the second flush mode of operation. It should be noted that the actuator assembly 5 may also be configured to be moved to additional positions to provide additional flush modes of operation.

The flush valve assembly 3 may include a valve body 30 that is configured to be operatively coupled to the tank 2, such as to a bottom wall 21 of the tank 2 through an outlet opening 22 disposed in the bottom wall 21. The flush valve assembly 3 may also include other components to help regulate or control the flow of water that is transferred from the tank 2 to the bowl during a flush cycle.

Figure 2:
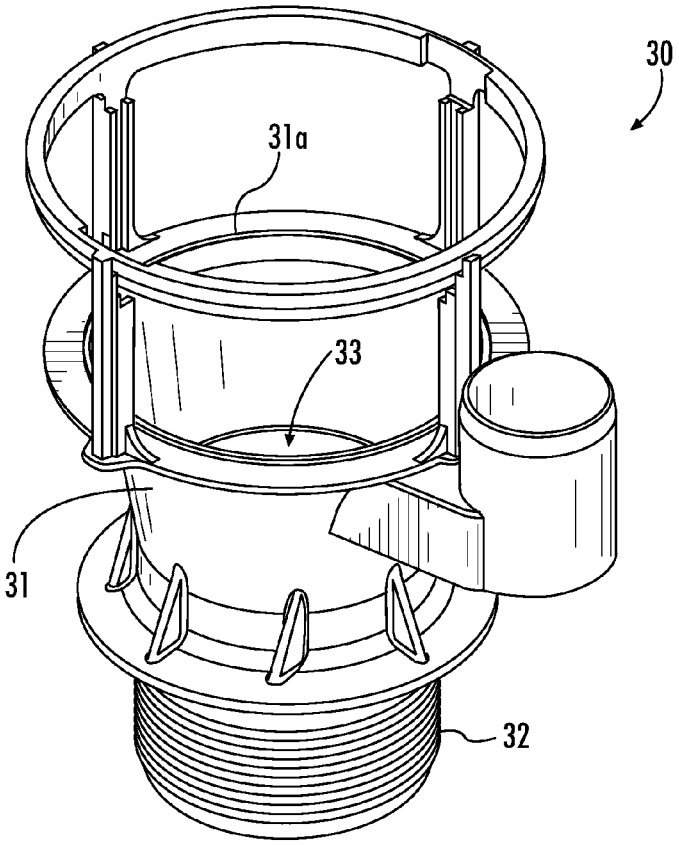
FIG. 2 is a perspective view of an exemplary embodiment of a valve body for use in a flush valve assembly.
Figure 3:
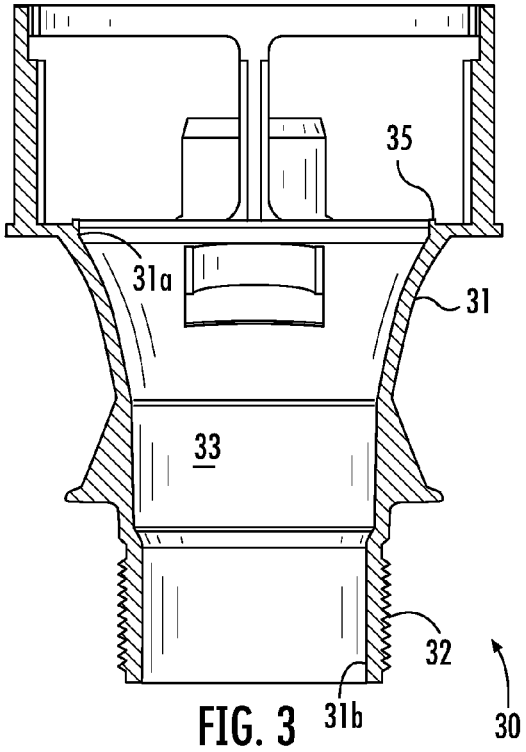
FIG. 3 is a cross-sectional view of the valve body of FIG. 2.
Figure 4:
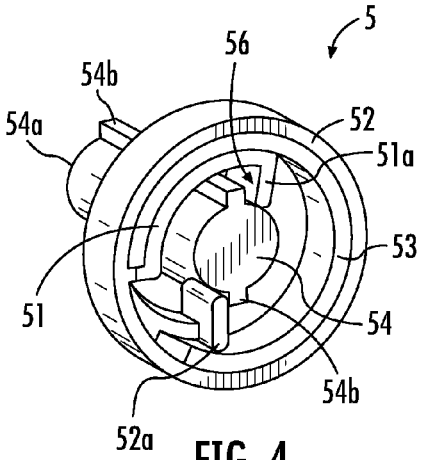
FIG. 4 is a perspective view of a portion of a flush valve actuator, according to an exemplary embodiment.

As shown in FIGS. 2 and 3, the valve body 30 includes a wall 31 and an end 32. The valve body 30 may be secured to the tank 2 through a fastener, such as a valve nut 27 (shown in FIG. 1), which may thread to threads disposed on the end 32 of the valve body 30. When coupled to the tank 2, the valve body 30 is configured to provide a passage 33 for the water to flow from the tank 2 to the bowl during a flush cycle. The wall 31 may extend between an inlet end 31*a* and an outlet end 31*b* to define the passage 33. The inlet end 31*a* is configured to receive the water from the tank and the outlet end 31*b* is configured to discharge the water to the bowl.

The wall 31 may be configured to increase the discharge flow rate of the dual flush valve assembly 3 by defining a cross-sectional area that reduces from the inlet end 31*a* to the outlet end 31*b*. In other words, the valve body 30 has an inlet opening (that is defined by the inlet end of the wall 31) and an outlet opening (that is defined by the outlet end of the wall 31), where the inlet opening has a cross-sectional area that is larger than the outlet opening. This arrangement may advantageously increase the flow rate of water through the dual flush valve assembly 3, since a flush valve assembly having inlet and outlet openings that are substantially equal in size may be subjected to restrictive flow, due in part, because air pockets may form between the fluid flow and the inside of the wall of the valve body. For example, the valve body 30 may have a two inch (2") diameter at the outlet end 31*b*, which may be configured to provide a high flow rate, such as when used in combination with a dual flush system. The valve body 30 may be configured to retro-fit with existing toilets, such that a single flush toilet can be converted into a dual flush toilet, such as by replacing the flush valve assembly and the actuator assembly of the toilet. Thus, the same vitreous can be offered to provide varying levels of functionality (e.g., single flush, dual flush), such as where the dual flush provides different volumes of water during the flush cycle.

Also shown in FIGS. 2 and 3, the wall 31 of the valve body 30 is configured having a concave conical shaped portion that narrows in diameter (and cross-section) as it transitions from the inlet end 31*a* to the outlet end 31*b*. However, the wall 31 may also be configured having a convex conical shaped portion, a straight cone shaped portion, or a portion having any suitable shape that changes (e.g., reduces) the cross-section of the valve body 30 between the inlet end 31*a* and the outlet end 31*b*.

As shown in FIG. 3, the valve body 30 includes a valve seat 35. The flush valve assembly 3 may include a moveable member (not shown) that is configured to move between a closed valve assembly position and one or more than one open valve assembly positions. In the closed valve assembly position, the moveable member abuts or contacts the valve seat 35 to prohibit water from entering the inlet end 31*a* of the valve body 31. In the one or more than one open valve assembly positions, the moveable member is moved to a location(s) forming a gap between the moveable member and the valve seat 35 to allow water to enter the inlet end 31*a* of the valve body 31. The size of the gap may differ between the different open valve assembly positions. For example, the gap may be larger for a full open valve assembly position relative to the size of the gap for a reduced open valve assembly position. Further, the moveable member may be driven by the actuator assembly 5, such that the actuator assembly 5 may control the movement of the moveable member to the one or more than one open valve assembly positions.

It should be noted that although FIGS. 2 and 3 illustrate the valve body according to an exemplary embodiment with specific features, the features of the valve body may be configured differently (e.g., having features that differ in size than the sizes shown, having features located in different locations than the locations shown, etc.) and the example disclosed is not limiting.

The toilet may also include an actuator assembly, such as the actuator assembly 5, having an actuator configured to control the flush modes of operation (e.g., two or dual modes of the operation) of the flush valve assembly 3. For example, for a dual flush toilet, the actuator may be configured to move from a first (e.g., rest, home, etc.) position to a second position to operate the toilet in the first mode of operation, and the actuator may be configured to move from the first position to a third position (and/or from the second position to the third positions) to operate the toilet in the second mode of operation. The actuator may be configured as a trip lever, a handle, or having any suitable arrangement or configuration that can transmit movement to control a flush cycle. It should be noted that actuator assembly 5 may be configured to move to additional positions to provide additional modes of operation. Also, as disclosed below, the multi-flush (e.g., dual flush) toilet may include more than one actuator, where an actuator may be configured to control each mode of operation of the toilet.

FIGS. 4-6B illustrate an exemplary embodiment of an actuator assembly 5 that includes a first lever 51 (e.g., first handle), a second lever 52 (e.g., second handle), a bushing 53, and a pivot pin 54 (e.g., trip arm axle). The first lever 51 is configured to be rotated by a user to actuate a first mode of operation of the flush valve assembly 3 of the toilet, such as where the toilet operates with a short flush cycle transferring a reduced volume of water (i.e., a volume less than a full volume of water) from the tank 2 to the bowl. The second lever 52 is configured to be rotated by a user (thereby also rotating first lever 51) to actuate a second mode of operation of the flush valve assembly 3, such as where the toilet operates with a full flush cycle transferring a full volume of water from the tank 2 to the bowl.

The pivot pin 54 includes a cylindrical body 54*a* that defines a pivot axis 50 and two extensions 54*b* that extend outwardly from the body 54*a*. The extensions 54*b* may be disposed on opposing sides or may be provided anywhere along the circumference of the body 54*a*. The pivot pin 54 may rotate about the pivot axis 50, such as relative to the tank, when driven by one of the first lever 51 and the second lever 52 to effect a mode of operation of the toilet and flush valve. Each extension 54*b* of the pivot pin 54 is configured to be engaged by one of the first and second levers 51, 52, whereby continued rotation of the respective lever (e.g., first lever 51, second lever 52) drives rotation of the pivot pin 54 a predetermined amount of rotation (e.g., an angular travel) to control the mode of operation of the flush valve assembly 3 of the toilet 1.

The first lever 51 may be configured as an elongated member that pivots about the pivot axis 50 between a first (e.g., closed) position and a second (e.g., open) position. The first position of the first lever 51 may correspond to the closed position of the flush valve assembly 3, and the second position of the first lever 51 may correspond to a reduced volume open position of the flush valve assembly 3. The first lever 51 includes an arm 51*a* that is configured to engage at least one extension 54*b* of the pivot pin 54 after a predetermined amount of rotation of the first lever 51, whereby continued rotation of the first lever 51 rotates the pivot pin 54 about the pivot axis 50. In other words, the actuator assembly 5 may be configured with a gap 56 disposed between the arm 51*a* of the first lever 51 and the extension 54*b* of the pivot pin 54, where the size (e.g., length) of the gap 56 influences the volume of water that is reduced from the full volume of the full flush during the first (e.g., reduced) mode of operation of the toilet.

The gap 56 may be sized such that a rotation A1 of the first lever 51 brings the arm 51*a* into contact with the at least one extension 54*b*, which is positioned at an initial position I (which is shown as being generally vertical, but may be positioned at any orientation based on the configuration of the pivot pin 54). For example, the gap 56 may be sized such that the first lever 51 rotates 5° (five degrees) to 15° (fifteen degrees) before the arm 51*a* of the lever 51 contacts the respective extension 54*b* of the pivot pin 54. More preferably, the gap 56 may be sized such that the first lever 51 rotates about 10° (ten degrees) before the arm 51*a* of the lever 51 contacts the respective extension 54*b* of the pivot pin 54. Thus, the gap in effect serves as dead travel (i.e., that does not rotate the pivot pin 54) of the first lever 51. After contact between the arm 51*a* and the extension 54*b*, the first lever 51 may be configured to rotate a second rotation A2, which in-turn rotates the pivot pin 54 a corresponding rotation to actuate a flush cycle, such as by opening a valve assembly operatively coupled to the pivot pin 54. For example, the second rotation A2 of the first lever 51 may be equal to 60° (sixty degrees). Thus, the first lever 51 of this example may be configured to be rotated 70° (seventy degrees) between its first and second positions, then when the first lever 51 is positioned in its second position, the pivot pin 54 has been rotated 60° (sixty degrees) by the first lever 51.

The second lever 52 may be configured as an elongated member that pivots about the pivot axis 50 between a first (e.g., closed) position and a second (e.g., open) position. The first position of the second lever 52 may correspond to the closed position of the flush valve assembly 3, and the second position the second lever 52 may correspond to a full volume open position of the flush valve assembly 3. The second lever 52 includes an arm 52*a* that is configured to engage an extension 54*b* of the pivot pin 54 directly (or indirectly) and immediately (or after a predetermined amount of rotation of the second lever 52), where continued rotation of the second lever 52 rotates the pivot pin 54 about the pivot axis 50. As shown, the arm 52*a* of the second lever 52 is configured to abut or contact the extension 54*b* of the pivot pin 54 in the first position, such that rotation of the second lever 52 drives a similar amount of rotation of the pivot pin 54.

Figure 6A:
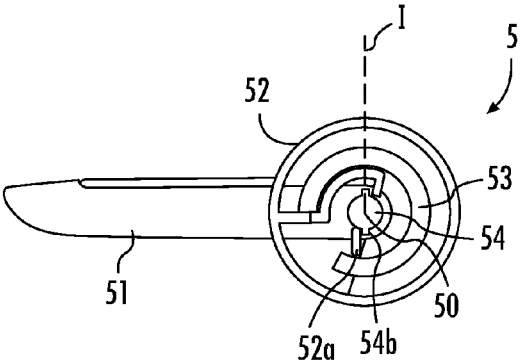
Figure 6B:
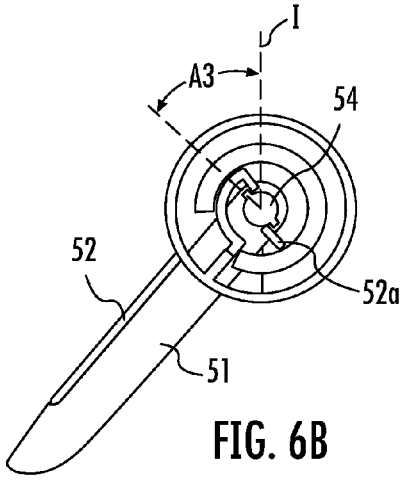
FIG. 6B is a front view of the flush valve actuator of FIG. 6A shown in a second position corresponding to a third (e.g., full flush) position of the flush valve of the toilet.

As shown in FIG. 6B, the second lever 52 is configured to rotate a rotation A3 to in-turn rotate the pivot pin 54 a corresponding rotation from the initial position I. For example, the second lever 52 may be configured to rotate 70° (seventy degrees) between its first and second positions, then when the second lever 52 is positioned in its second position, the pivot pin 54 has been rotated 70° (seventy degrees) by the second lever 52. The rotation A2 may be tailored, such as to provide a different performance or accommodate different toilets. However, it should be noted that the actuator assembly 5 may be configured with a gap disposed between the arm 52*a* of the second lever 52 and the respective extension 54*b* of the pivot pin 54, where the size (e.g., length) of the gap influences the volume of water that is transferred from the tank 2 to the bowl during a second (e.g., full flush) mode of operation of the toilet.

Figure 5A:
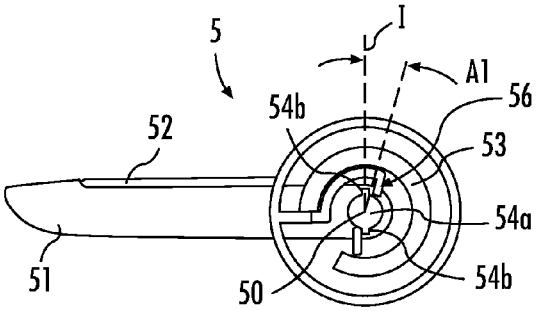
FIGS. 5A and 6A are front views of the flush valve actuator of FIG. 4 shown in a first position corresponding to a closed position of the flush valve of the toilet.
Figure 5B:
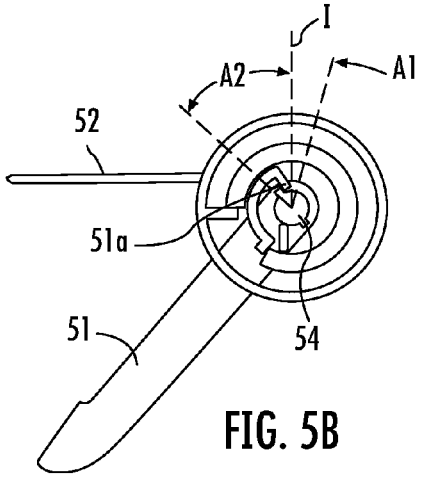
FIG. 5B is a front view of the flush valve actuator of FIG. 5A shown in a second position corresponding to a second (e.g., reduced flush) position of the flush valve of the toilet.

Additionally, the first and second levers 51, 52 may be configured to operate cooperatively or may operate independently. As shown in FIG. 6B, the rotation of the second lever 52 is configured to rotate the first lever 51*a* similar amount of angular rotation, where, as shown in FIG. 5B, the rotation of the first lever 51 does not drive rotation of the second lever 52. However, the actuator assembly 5 may have a different configuration, such as where both the first and second levers 51, 52 rotate independently of each other. For example, the handles may have a side-by-side configuration, where each handle may rotate independently of the other handle.

The bushing 53 is configured to guide the rotation of the first lever 51 and/or the second lever 52 about the pivot axis 50 relative to the tank 2 and/or the pivot pin 54. The bushing 53 may be configured as an annular member or a semi-annular member (e.g., an annular member with a void therein, a discontinuous member). According to an exemplary embodiment, the bushing 53 is disposed between a portion of the first lever 51 and a portion of the second lever 52 to guide rotation of the levers.

The actuator assembly 5 may also include a biasing member (not shown), such as a clock spring, that is configured to bias the actuator assembly 5 into a position, such as the first or closed position. For example, the biasing member may bias the first lever 51 into its first or closed position and/or may bias the second lever 52 into its first or closed position. The biasing member may also be configured to bias the pivot pin 54, or may have any suitable configuration to bias the actuator assembly 5.

Figure 7:
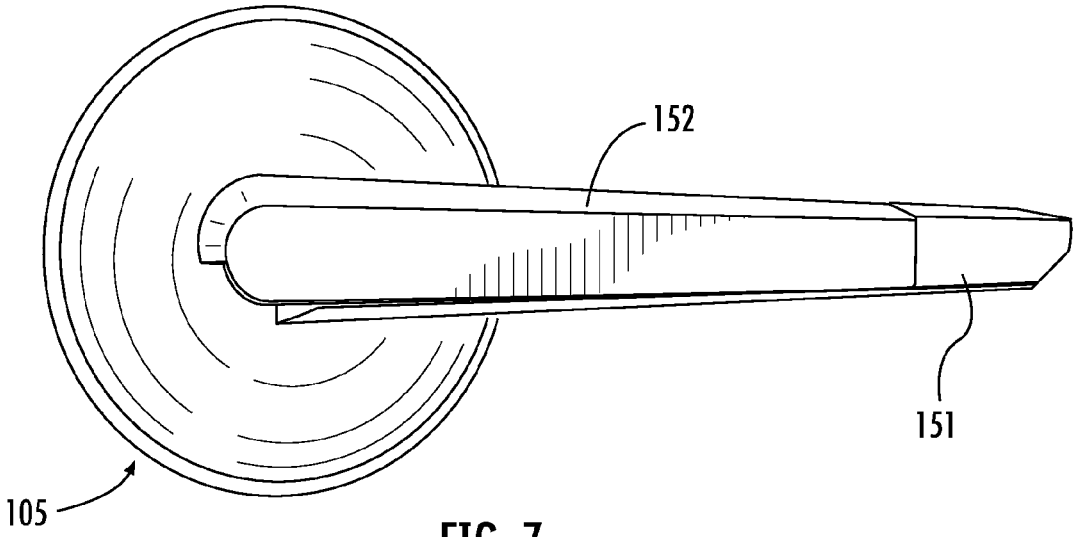
FIG. 7 is a front view of another exemplary embodiment of a flush valve actuator shown having a nested arrangement.

FIG. 7 illustrates another exemplary embodiment of a nested actuator assembly 105 including a first lever 151 and a second lever 152. One handle (e.g., the first handle 151) of the nested actuator assembly 105 is configured to nest within the other handle (e.g., the second handle 152). The first lever 151 is configured to be rotated by a user to actuate a first mode of operation of the flush valve assembly 3 of the toilet, such as where the toilet operates with a reduced (e.g., half) flush cycle transferring a reduced volume of water (i.e., a volume less than full, such as, half of the full volume) from the tank 2 to the bowl. The second lever 152 is configured to be rotated by a user to actuate a second mode of operation of the flush valve assembly 3, such as where the toilet operates with a full flush cycle transferring a full volume of water from the tank 2 to the bowl. When neither lever 151, 152 is rotated, the flush valve assembly 3 is configured to operate in a third (e.g., closed) mode of operation where the flush valve assembly 3 is closed and prohibits the transfer any water from the tank 2 to the bowl, such as between flush cycles of the toilet.

As shown in FIG. 7, the second lever 152 is configured to wrap around the top and at least one side of the first lever 151. The second lever 152 may have a C-shaped cross-section that defines a channel (e.g., cavity) that is configured to receive the first lever 151 therein, where the second lever 152 wraps around both sides of the first lever 151. The second lever 152 may have a generally rectangular cross-section that is tailored to fit within the channel formed by first lever 151, such that the channel is at least as deep as the height of the first lever 151. Alternatively, the second lever 152 may have an L-shaped cross-section, where the second lever 152 wraps around an exterior (e.g., visible) side of the first lever 151, or may have another suitable configuration to provide for nesting of the handles. In other words, the shape of the levers 151, 152 may be configured so that one lever (e.g., first lever 151) is configured to nest in the other lever (e.g., second lever 152). It is noted that the levers 151, 152 may have other suitable configurations that are configured to nest together.

The nesting configuration of the first and second levers may provide several advantages, only some of which are discussed herein. First, the nested configuration of the handles produces a more compact arrangement, and therefore, utilizes a relatively small volume. For example, the nested arrangement of the two handles shown in FIG. 7 may be configured to occupy the same or less volume than a single conventional handle. Second, the nested configuration of the handles may be more hygienic or sanitary. For example, the nested handles may have less surface area or features (e.g., seams), such as relative to two non-nested handles, for germs or bacteria to collect in, and therefore, may improve the overall sanitary condition of the toilet having the nested handles. Third, the nested configured of the handles may be easier (e.g., quicker) to clean, possibly making them ideal to a homeowner or other person who would clean the toilet and the handles.

Figure 8:
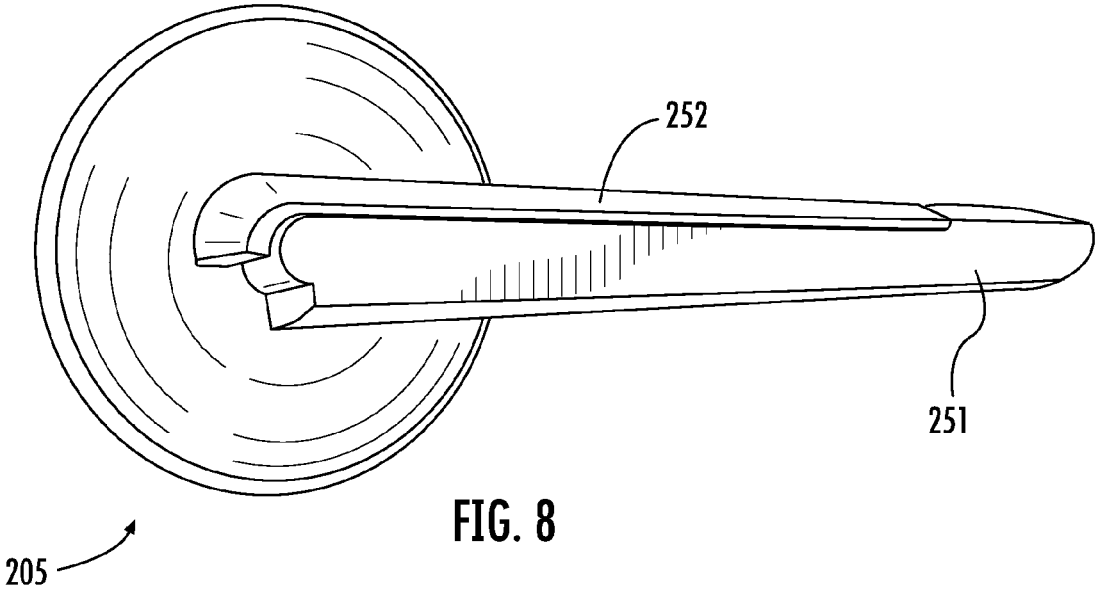
FIG. 8 is a front view of another exemplary embodiment of a flush valve actuator shown having an exposed arrangement.

FIG. 8 illustrates another exemplary embodiment of an exposed actuator assembly 205. As shown, the second lever 252 is configured to not nest with the first lever 251, but rather is disposed adjacent (e.g., above) to the first lever 251 when both levers are in closed valve position. In other words, the second lever 252 and first lever 251 may abut or contact each other along the adjacent surfaces, such as along the top surface of the first lever 251 (e.g., long handle) and the bottom surface of the second lever 252 (e.g., short handle), but not along the sides. Accordingly, the lower surface of the second lever 252 may be configured to match the upper surface of the first lever 251 when both levers are in the closed valve position. It is noted that the levers 251, 252 may have different configurations and may have any suitable shape.

Figure 9:
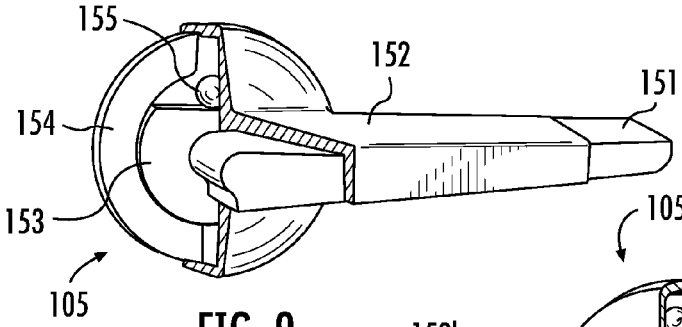
FIGS. 9-9E are various views of another exemplary embodiment of a flush valve actuator shown in various positions of operation.
Figure 9A:
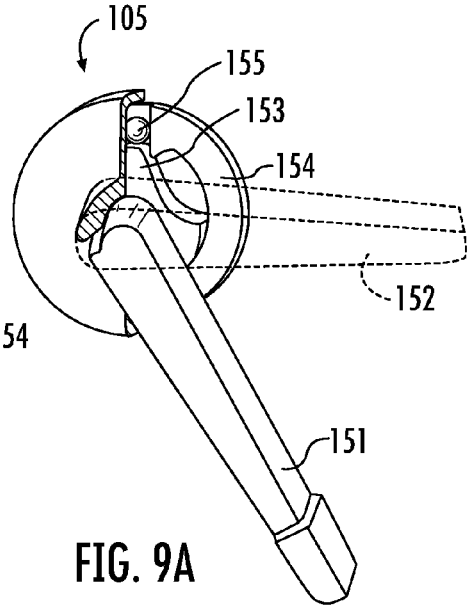
Figure 9B:
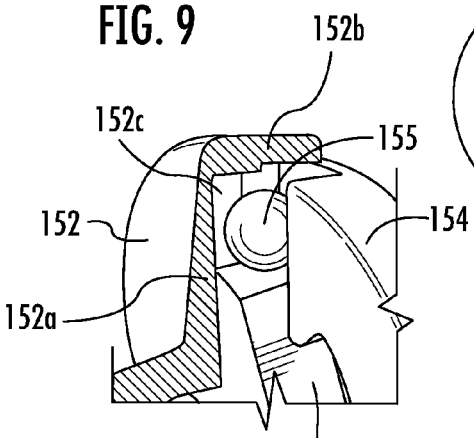
Figure 9C:
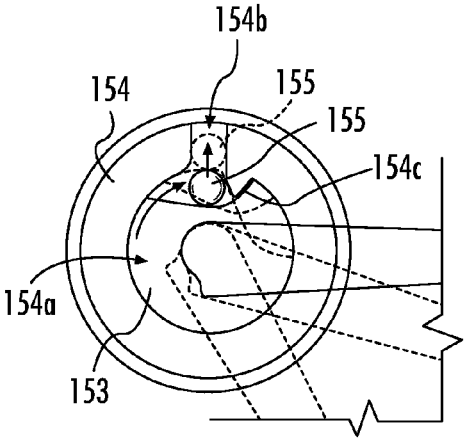
Figure 9D:
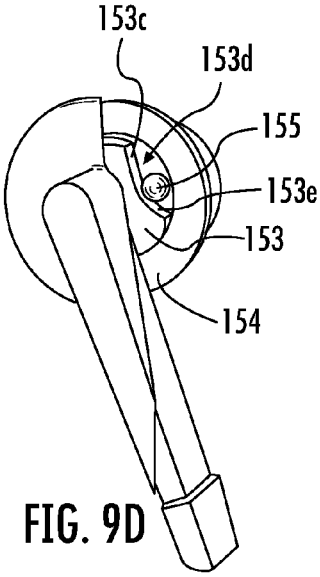
Figure 9E:
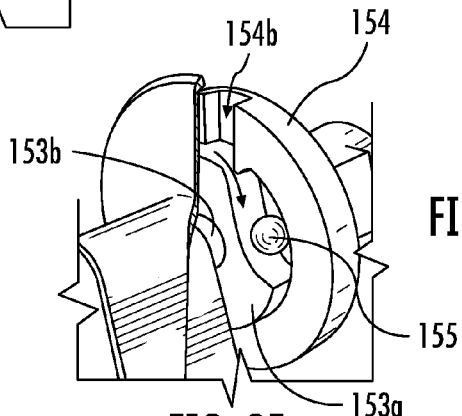

As shown in FIGS. 9-9E, the actuator assembly 105 may also include a cam 153, a guide member 154 (e.g., a bushing), and a moveable element 155 (e.g., moving member). As shown, the moveable element 155 is configured as a ball or ball bearing. However, the moving element may be configured differently than a ball bearing.

The cam 153 may be operatively coupled to the first lever 151 such that rotation of the first lever 151 rotates the cam 153 a similar amount of angular travel. The cam 153 may have a base 153*a* and a shoulder 153*b* extending away from the base 153*a*. The shoulder 153*b* is configured to engage a handle of the actuator assembly 105, such as a cavity of the first lever 151 in order for rotation of the first lever 151 to rotate the cam 153 a corresponding amount. The base 153*a* may be generally cylindrical with a cam surface 153*c* provided on a notched portion 153*d* of the base 153*a*. The cam surface 153*c* is configured to drive movement of the moveable element 155 upon rotation of the cam 153, such as by rotation of the first lever 151. The base 153*a* may also include a stop surface 153*e* provided on the notched portion 153*d*, such as on an opposing end thereof. The cam and stop surfaces 153*c*, 153*e* may be configured to limit the rotational travel of the cam 153 (and the first lever 151 coupled thereto) to control the mode of operation of the flush cycle.

The guide member 154 may be coupled to the tank of the toilet, such as on the outside of the tank. The guide member 154 may also be coupled to a housing disposed on the inside of the tank. The guide member 154 includes a cavity 154*a* configured to receive the cam 153 therein and a slot 154*b* that is configured for the moveable element 155 to move therein. The cavity 154*a* may be generally cylindrical to allow the cam 153 to rotate within the cavity, and the slot 154*b* may extend outwardly away from the cavity 154*a*. As shown, the slot 154*b* extends in a radial direction away from the cavity 154*a*. The slot 154*b* may have a size (e.g., width) tailored to the size of the moveable element 155. The guide member 154 may also include a projection 154*c*, which may extend into the cavity 154*a*. As shown, the projection 154*c* is configured adjacent the slot 154*b*. The projection 154*c* may act as a stop to limit the rotation of the cam 153, such as upon contact between the cam surface 153*c* and the projection 154*c* and/or between the stop surface 153*e* and the projection 154*c*.

When the first lever 151 is rotated without rotating the second lever 152, the cam 153 rotates within the cavity 154*a* relative to the guide member 154 and second lever 152 to drive the moveable element 155 outward in the radial direction in the slot 154*b*. For example, the second lever 152 may include a directing element that is configured to direct the movement of the moveable element 155 into the slot 154*b*. Upon a predetermined rotation of the first lever 151, an interference fit (e.g., interference condition) is created to limit additional rotation of the first lever 151. For example, the cam surface 153*c* may contact the projection 154*c* after the predetermined rotation. Also for example, a portion of the first lever 151 may contact a portion of the second lever 152 to prohibit additional relative rotation therebetween.

The moveable element 155 may also prohibit rotation of the second lever 152 when the moveable element 155 is positioned in the interference condition. For example, the second lever 152 may include a stop feature (e.g., an tab, an ear, etc.) that is configured to contact the moveable element 155 to prohibit rotation of the second lever 152. As shown in FIG. 9B, the second lever 152 has a base 152*a*, an end 152*b* extending away from the base 152*a*, and a stop tab 152*c*. The stop tab 152*c* may extend between the base 152*a* and the end 152*b* and be configured to contact the moveable element 155 when in the interference condition. The walls that define the slot 154*b* of the guide member 154 prohibit movement of the moveable element 155 in a direction transverse to the length of the slot 154*b* (e.g., in a rotational direction), such that upon contact of the moveable element 155 by the stop tab 152*c*, the second lever 152 is prohibited from rotation.

When both the first and second levers 151, 152 are rotated together, such as when a user tries to move the second lever 152, the moveable element 155 moves freely with the cam 153 in the cavity 154*a* of the guide 154, such that no interference fit is created. For example, since the second lever 152 is rotating with the cam 153, the moveable element 155 does not contact the directing element of the second lever 152 and the moveable element 155 may remain in the notched portion 153*d* of the cam 153, allowing additional rotation of the levers 151, 152.

The actuator assembly 105 assembly may be configured to operate two modes of operation of the flush cycle of the toilet. For example, a rotation of the first lever 151 may operate a first mode of operation flush cycle, and a rotation of the first and second levers 151, 152 together may operate a second mode of operation of the flush cycle.

Figure 10A:
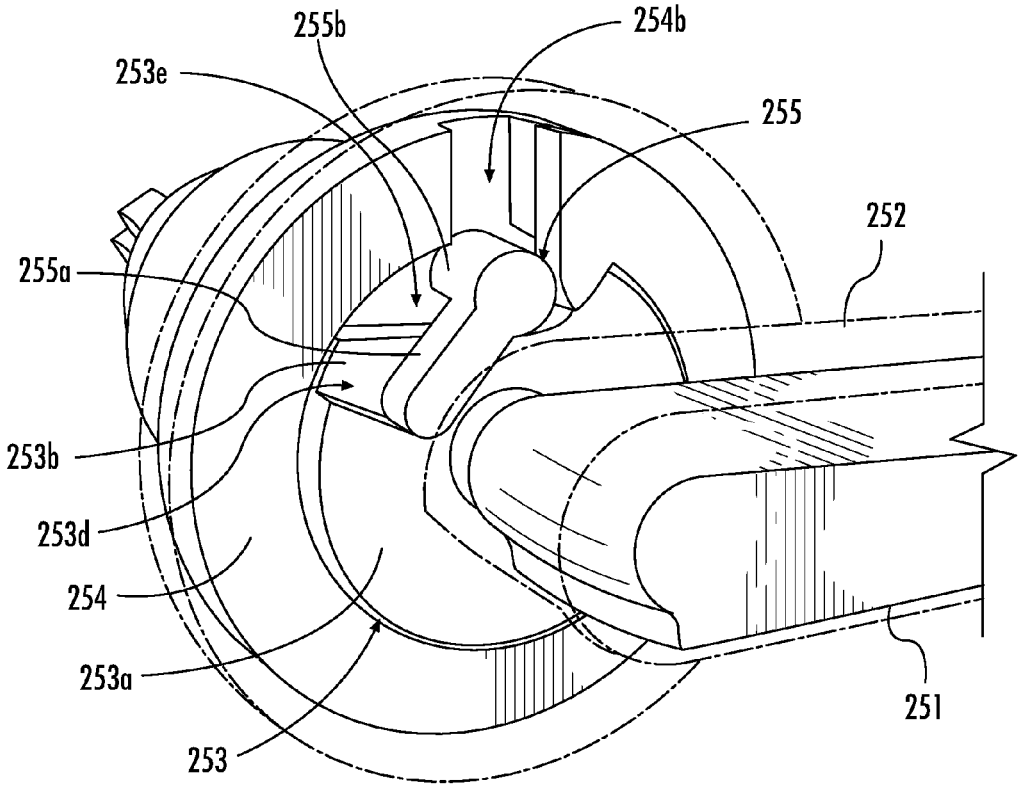
FIGS. 10A and 10B are perspective views of another exemplary embodiment of a flush valve actuator.
Figure 10B:
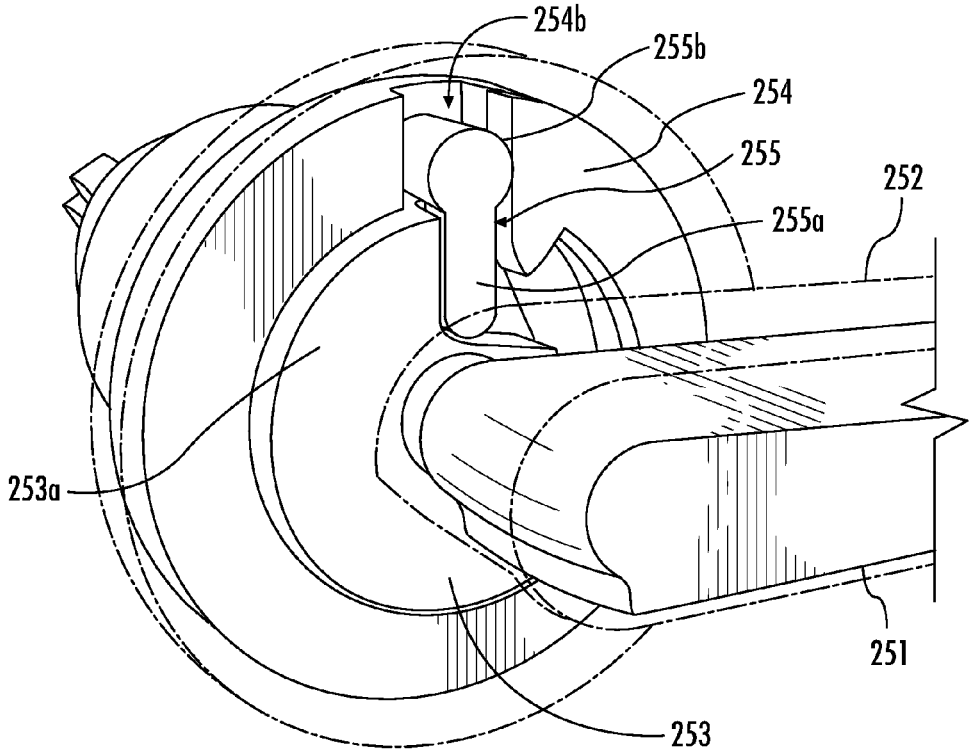

As shown in FIGS. 10A and 10B, the actuator assembly 205 includes a first handle 251, a second handle 252, a cam 253, a guide member 254 (e.g., a bushing), and a moveable element 255 configured as a finger element rather than a ball bearing. The first and second handles 251, 252 may be generally configured as described above for the first and second levers 151, 152. The guide member 254 may also be configured generally as described above for the guide member 154.

The moveable element 255 configured as a finger element includes a first portion 255*a* and a second portion 255*b*. As shown, the first portion 255*a* is a pin or an elongated member, and the second portion 255*b* is a cylindrical member that extends away from an end of the first portion 255*a* in direction transverse to a longitudinal axis.

As shown, the cam 253 is bi-planar, including a first side 253*a* and a second side 253*b* disposed adjacent to the first side 253*a*. The first side 253*a* of the cam 253 includes a notched portion 253*d* that is configured to receive a portion of the moving member, such as the first portion 255*a*. The notched portion 253*d* is defined by a first surface (e.g., a first cam surface) of the first side 253*a*, where the first surface is configured to drive the first portion 255*a* of the moveable element 255, such as into a slot of the guide member 254. The first side 253*a* may also include additional surfaces, such as a stop surface configured to limit the rotational travel of the cam 253. The second side 253*b* of the cam 253 includes a notched portion 253*e*, which may have a different shape than the notched portion 253*d* of the first side 253*a*, such as to accommodate the first portion 255*a*. For example, the notched portion 253*e* of the second side 253*b* may be larger than the notched portion 253*d* of the first side 253*a* in order to receive the elongated member therein. The second side 253*b* may include a second surface (e.g., a second cam surface) that is configured to move the moveable element 255, such as by contacting an end of the first portion 255*a* of the moveable element 255.

The actuator assembly 205 is configured to provide more than one mode of operation of the flush cycle. For example, the actuator assembly 205 may provide a first mode of operation by rotating only the first handle 251, and may provide a second mode of operation by rotating the first and second handles 251, 252 together. Rotation of the first handle 251 alone may drive the moveable element 255 into the slot 254*b* of the guide member 254, which may limit rotation of the handle after a predetermined rotation. Rotation of the first and second handles 251, 252 may rotate the moveable element 255 past the slot 254*b*. It should be noted that the moveable element 155 may be configured differently and still provide the selective locking of the actuator assembly 105.

Figure 11:
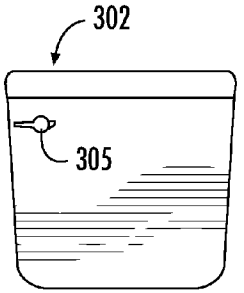
FIG. 11 is a front view of an exemplary embodiment of a toilet tank having a left-hand mount actuator.
Figure 11A:
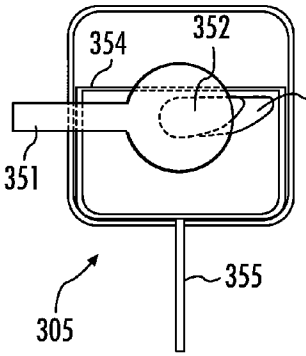
FIGS. 11A-11C are front schematic views of the tank of FIG. 11 shown with the actuator in various operating positions.
Figure 11B:
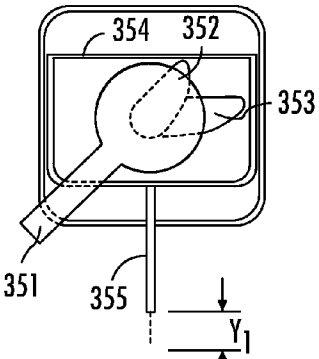
Figure 11C:
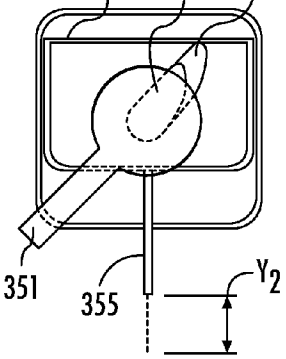
Figure 12:
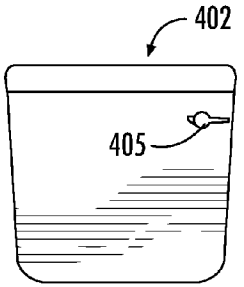
FIG. 12 is a front view of an exemplary embodiment of a toilet tank having a right-hand mount actuator.
Figure 12A:
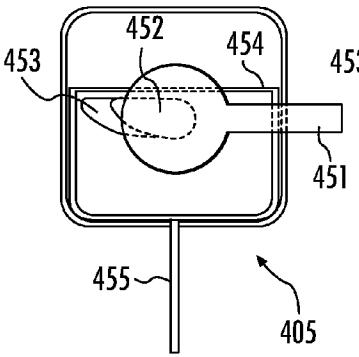
FIGS. 12A-12C are front schematic views of the tank of FIG. 12 shown with the actuator in various operating positions.
Figure 12B:
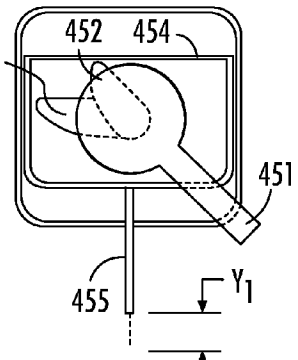
Figure 12C:
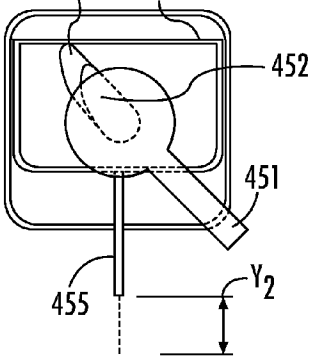

FIGS. 11-12C illustrate other exemplary embodiments of actuator assemblies. FIG. 11 illustrates a tank 302 that includes a left-hand (e.g., left-side) mounted actuator assembly 305 coupled thereto, while FIG. 12 illustrates a tank 402 that includes a right-hand mounted actuator assembly 405 coupled thereto. The actuator assembly 305 includes a handle 351 that is configured to rotate about a pivot axis to thereby rotate a first member 352 and/or a second member 353. Thus, the handle 351 may be configured to move one or both of the first and second members 352, 353. The first and second members 352, 353 may be configured having different lengths to control the flush mode operation(s) of the valve assembly of the toilet. For example, the second member 353 may be longer than the first member 352, wherein the length influences the flush cycle. When the handle 351 rotates just the first member 352, the first member 352 moves a moving member 354 a first distance, as shown in FIG. 11B, which in turn moves a linking member 355 a distance $Y_1$, which may be substantially similar to the first distance. When the handle 351 rotates both the first member 352 and the second member 353, the second member 353 moves the moving member 354 a second distance, as shown in FIG. 11C, which in turn moves the linking member 355 a distance $Y_2$, which may be substantially similar to the second distance. The linking member 355 may be configured to actuate or control the flush valve through its movement. Additionally, by being configured to move a first distance and a second distance, the linking member 355 is able to control two different flush modes of operation of the toilet. For example, the distance $Y_1$ of movement by the linking member 355 may actuate a first (e.g., reduced, short, etc.) flush mode of operation of the toilet, and the distance $Y_2$ of movement by the linking member 355 may actuate a second (e.g., full, long, etc.) flush mode of operation. The linking member 355 may be configured as a chain, a bar, as another connecting device, or may have any suitable configuration that operatively connects the actuator assembly and valve assembly.

The actuator assembly 405 may be configured similar to the actuator assembly 305, but symmetrically opposite in order to provide a right-hand side actuator. The actuator assembly 405 includes a handle 451 that is configured rotate about a pivot axis to thereby rotate a first member 452 and/or a second member 453. When the handle 451 rotates just the first member 452, the first member 452 moves a moving member 454 a first distance, as shown in FIG. 12B, which in turn moves a linking member 455 a distance $Y_1$ substantially similar to the first distance. When the handle 451 rotates both the first member 452 and the second member 453, the second member 453 moves the moving member 454 a second distance, as shown in FIG. 12C, which in turn moves the linking member 455 a distance $Y_2$ substantially similar to the second distance. It should be noted that the actuator assembly 305, 405 may be configured differently. For example, the actuator assembly 305, 405 may include a second handle, where the first handle moves just the first member 452 and the second handle moves just the second member 453. Also for example, the actuator assembly may include a handle configured to move only one member at a time, depending on the mode of operation of the toilet.

Figure 13:
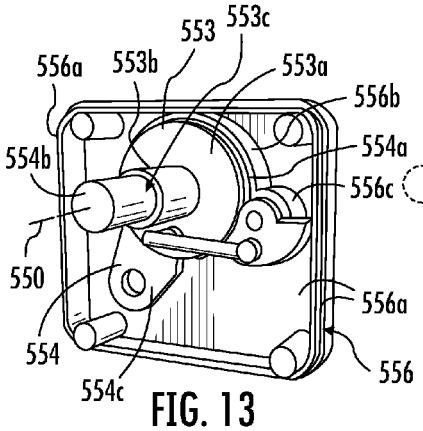
FIG. 13 is a perspective view of another exemplary embodiment of a flush valve actuator shown in a first position and with the handles removed for clarity.
Figure 13A:
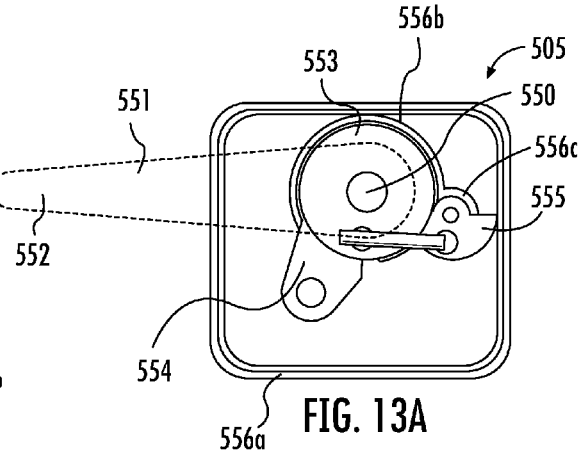
FIG. 13A is a front view of the flush valve actuator of FIG. 13 with the handles shown.
Figure 14:
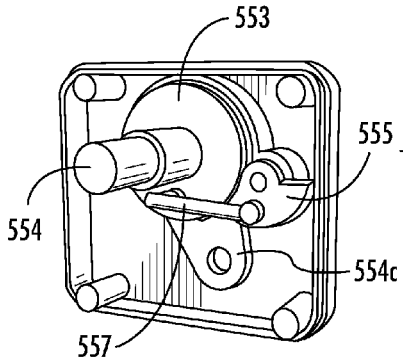
FIG. 14 is a perspective view of the flush valve actuator of FIG. 13 shown in a second position and with the handles removed for clarity.
Figure 14A:
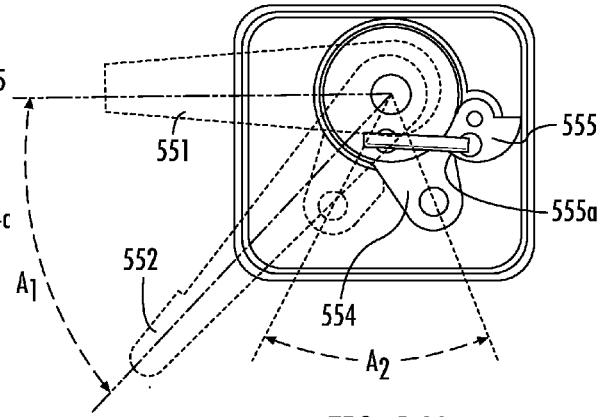
FIG. 14A is a front view of the flush valve actuator of FIG. 14 with the handles shown.
Figure 15:
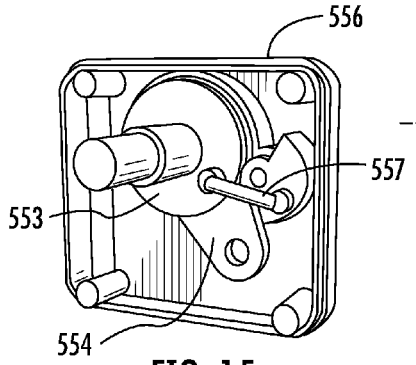
FIG. 15 is a perspective of the flush valve actuator of FIG. 13 shown in a third position and with the handles removed for clarity.
Figure 15A:
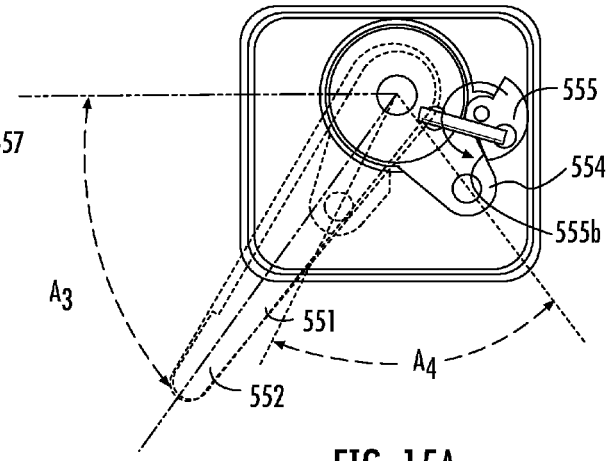
FIG. 15A is a front view of the flush valve actuator of FIG. 15 with the handles shown.

FIGS. 13-15A illustrate another exemplary embodiment of an actuator assembly 505, which is shown in various configurations in the various views. FIGS. 13 and 13A illustrate the actuator assembly 505 configured in a first position corresponding to a closed position of the valve assembly of the toilet. FIGS. 14 and 14A illustrate the actuator assembly 505 configured in a second position corresponding to a first open position of the valve assembly (e.g., a first mode of operation) to control the transfer of a first volume of water from the tank to the bowl through the valve assembly. FIGS. 15 and 15A illustrate the actuator assembly 505 configured in a third position corresponding to a second open position of the valve assembly (e.g., a second mode of operation) to control the transfer of a second volume of water from the tank to the bowl through the valve assembly.

As shown, the actuator assembly 505 (e.g., actuation mechanism) includes a first handle 552 (e.g., a long handle) and a second handle 551 (e.g., a short handle), both of which are configured to rotate about a common pivot axis 550. The actuator assembly 505 also includes a first member 553 (e.g., a first cam, a first link arm member) operatively coupled to the second handle 551, and a second member 554 (e.g., a second cam, a second link arm member) operatively coupled to the first handle 552. The first member 553 may be integrally formed with the second handle 551 or may be formed separately and configured to functionally cooperate with the second handle 551. The second member 554 may be integrally formed with the first handle 552 or may be formed separately and configured to functionally cooperate with the first handle 552. Accordingly, rotation of the second handle 551 (and, therefore the first handle 552) is configured to actuate a first flush mode of operation of the flush valve assembly, such as, for example, through an intermediate member, and rotation of only the first handle 552 is configured to actuate a second flush mode of operation of the flush valve assembly, which is different than the first flush mode of operation. Thus, the members 553, 554 of the actuator assembly 505 may be configured to actuate the flush valve assembly to effect a flush cycle of the toilet when the handle(s) are rotated. For example, the first member 553 may control a first flush mode of the toilet, and the second member 554 may control a second flush mode of the toilet.

The actuator assembly 505 may be configured to include a first handle 552 configured to be mounted to a first side (e.g., the outside) of a toilet tank (not shown), a second handle 551 mounted coaxially relative to the first handle 552 and configured to be mounted to the first side of the toilet tank, a housing 556 configured to be mounted to a second side (e.g., the inside) of the toilet tank, a link arm member (e.g., second member 554, first member 553, a combination thereof, etc.) provided within the housing 556 and pivotally coupled to the first and second handles 552, 551, and a moveable stop member 555 provided within the housing 556. A rotation of one of the first handle 552 and the second handle 551 results in rotation of the link arm member being limited by the moveable stop member 555 such that the link arm member is permitted to rotate a first amount to provide a partial flush for the toilet assembly. Additionally, rotation of both the first handle 552 and the second handle 551 results in movement of the moveable stop member 555 such that the link arm member is permitted to rotate a second amount greater than the first amount to provide a full flush for the toilet assembly.

The link arm member of the actuator assembly 505 may include a first link arm member in the form of the first member 553, which may be coupled to the second handle 551, and may also include a second link arm member in the form of the second member 554, which may be coupled to the first handle 552. Thus, the first and second link arm members may be mounted coaxially, where the pivot axis of the first and second link arm members may be concentric or coaxial to the pivot axis 550 of the handles. The actuator assembly 505 may include a drive member 557 that is configured to move the stop member 555, such as upon rotation of the second handle 551. For example, rotation of the second handle 551 may rotate the first member 553, which may in-turn rotate the stop member 55 through the drive member 557. For example, the drive member 557 may include a first end pivotally coupled to the first link arm member and a second end pivotally coupled to the stop member 555. Accordingly, for this example, rotation of only the first handle 552 results in rotation of only the second link arm member, and therefore the stop member 555 is not moved, such as to limit the travel of the second link arm member.

As shown, the first member 553 includes body 553*a*, an extension 553*b* extending from the body 553*a*, and a bore 553*c* extending through both the body 553*a* and the extension 553*b*. The bore 553*c* defines a longitudinal axis that is configured to be generally concentric with the pivot axis 550 to allow the first member 553 to rotate about the pivot axis 550. The bore 553*c* may also be configured to receive the second member 554, such that the first member 553 straddles the second member 554 in a pivotal arrangement. The extension 553*b* may be configured to be coupled to one of the handles. For example, the extension 553*b* may be configured to be coupled to the second handle 551, such that rotation of the second handle 551 rotates the first member 553 a corresponding amount.

As shown, the second member 554 includes a body 554*a* and an extension 554*b* extending from the body 554*a*. The extension 554*b* may be configured to engage the bore 553*c*, such as to pivotally couple the first and second members 553, 554 about the pivot axis 550. The extension 554*b* may also be coupled to one of the handles. For example, the extension 554*b* may be configured to be coupled to the first handle 552, such that rotation of the first handle 552 rotates the second member 554 a corresponding amount.

The housing 556 may be configured to house one or more of the components of the actuator assembly 505. For example, the housing 556 may house the first and second members 553, 554, the stop member 555, and the drive member 557. The housing 556 may be configured to be mounted to the tank of the toilet, such as to a surface of the tank to hold the actuator assembly 505 in place on the tank. For example, the housing 556 may be configured to be mounted to an opposing side of the tank relative to the handles 551, 552, such as, where the handles are mounted on a first side (e.g., an outside) of the tank and the housing is mounted on a second side (e.g., an inside) of the tank.

As shown, the housing 556 includes a plurality of external walls 556*a* that define a hollow member for housing at least a portion of the first member 553 and at least a portion of the second member 554. The housing 556 may also include an internal wall 556*b* that defines a cavity for receiving at least a portion of the body 554*a* of the second member 554. As shown, the internal wall 556*b* is cylindrically shaped to receive a mating cylindrical portion of the body 554*a* to allow for rotation of the second member 554 relative to the housing 556. The housing 556 may also include an element that is configured to define the pivot axis 550 of the actuator assembly 505. For example, the housing 556 may include an opening (e.g., a cylindrical opening) in at least one external wall 556*a* that is configured to be concentric with the pivot axis 550 and configured to receive a shoulder of the second member 554. Alternatively, the housing 556 may include a projection (e.g., a cylindrical projection) that is concentric with the pivot axis 550 and configured to receive an opening, such as a bore, in the second member 554. The body 554*a* of the second member 554 may include the opening that receives the projection of the housing 556 to pivotally couple the second member 554 to the housing 556.

The actuator assembly 505 may also have a stop member 555 that is configured to limit the rotational travel of the second handle 551 and/or the first handle 552. The actuator assembly 505 may be configured such that the second handle 551 and the first handle 552 are limited to different amounts of rotational travel (e.g., angular travel) by the stop member 555. The stop member 555 may be a fixed stop, or may be configured to be selectively moved (e.g., rotated), such as to permit different amounts of rotational travel between the handles.

As shown, the stop member 555 is pivotally coupled to the housing 556 at a pivot axis that is substantially parallel and offset from the pivot axis 550. In other words, the stop member 555 rotates about a pivot axis that is offset from and substantially parallel to a pivot axis 550 of the handles. The housing 556 may include a second inner wall 556*c* that defines the pivot axis of the stop member 555. The stop member 555 may be configured to rotate between a first position and a second position.

As shown in FIGS. 14 and 14A, when the stop member 555 is in the first position, the stop member 555 limits the rotation of the first handle 552 to a rotation $A_1$ in order to provide the maximum travel of the first handle 552 for operating a first mode of operation of the flush valve assembly (e.g., a reduced flush cycle). As shown, the second member 554 includes an arm 554*c* that extends outwardly from the pivot axis 550. The arm 554*c* may be configured to contact a first stop surface 555*a* of the stop member 555 after rotating a rotation $A_2$. The arm 554*c* may be configured as a cam having a cam surface that is configured to contact the moveable stop member 555.

As shown in FIGS. 15 and 15A, when the stop member 555 is in the second position, the stop member 555 limits the rotation of the first handle 552 to a rotation A3 in order to provide the maximum travel of the handles 551, 552 for operating a second mode of operation of the flush valve assembly (e.g., a full flush cycle). As shown, rotation of the second handle 551 drives rotation of the first handle 552 as well as driving movement (e.g., rotation) of the stop member 555 to its second position, which allows the first handle 552 to rotate farther than when the stop member 55 is in its first position by allowing additional rotation of the arm 554*c*. In other words, the stop member 555 may be configured to rotate when both handles are rotated to allow for additional rotational travel of the second member 554 by allowing the arm 554*c* to rotate a greater angular travel.

The first member 553 may drive the movement (e.g., rotation) of the stop member 555. For example, the actuator assembly 505 may also include a drive member 557 (e.g., a linking member) that is operatively connected to the first member 553 and the stop member 555, where rotation of the first member 553 drives the rotation of the stop member 555 through the drive member 557. As shown, the drive member 557 is an elongated member having a first end that is coupled (e.g., pivotally coupled) to the first member 553, such as to a projection extending from the body 553*a*. The projection of the first member 553 may extend generally parallel and offset from the pivot axis 550, and radial distance from the pivot axis 550 may be tailored to influence the movement of the stop member 555. The drive member 557 may have a second end that is coupled (e.g., pivotally coupled) to the stop member 555, such as to a projection extending from the stop member 555 in a direction that is generally parallel and offset from the pivot axis of the stop member 555. The radial distance from the pivot axis of the stop member 555 to the projection of the stop member 555 coupled to the second end of the drive member 557 may be tailored to influence the movement of the stop member 555.

Alternatively, the actuator assembly 505 may include a cam that is configured to move the stop member 555 from the first position to the second position. Accordingly to an example, the cam may be integrally formed with the first member 553, such as with the base 553*a*, so that the cam of the base 553*a* is provided coaxially with the second handle 551 and driven to rotation about the pivot axis 550 of the second handle 551 by rotation of the second handle 551. The cam of the base 553*a* may include a cam surface, which may be disposed along a portion of an outer edge of the cam. For example, the cam may be disposed along an external surface of the base 553*a*, which may extend in a plane that is transverse to the pivot axis of the stop member 555.

According to another example, the drive member 557 may be configured as a cam that is configured to move the stop member 555 from the first position to the second position. The cam may be configured to be concentric to (e.g., coaxial with) the pivot axis of the handles or offset from the pivot axis of the handles. The cam may be coupled to the first member 553 or integrally formed therewith. The cam may include a cam surface that is configured to move the stop member 555.

The actuator assembly 505 may also include a biasing member (or more than one biasing member). For example, the actuator assembly 505 may include a biasing member that is configured to influence (e.g., bias) the rotation of the stop member 555, such as in a rotational direction from the second position to the first position.

FIGS. 16-24 illustrate another exemplary embodiment of an actuator assembly 605 that is configured to control the operation of the flush valve assembly of the toilet, such as, to control the flush valve to provide at least two flush modes of operation of the toilet. The actuator assembly 605 may include a first handle 651 (e.g., long arm), a second handle 652 (e.g., short arm), a shaft 653, a housing 654, and a link arm 655.

Figure 16:
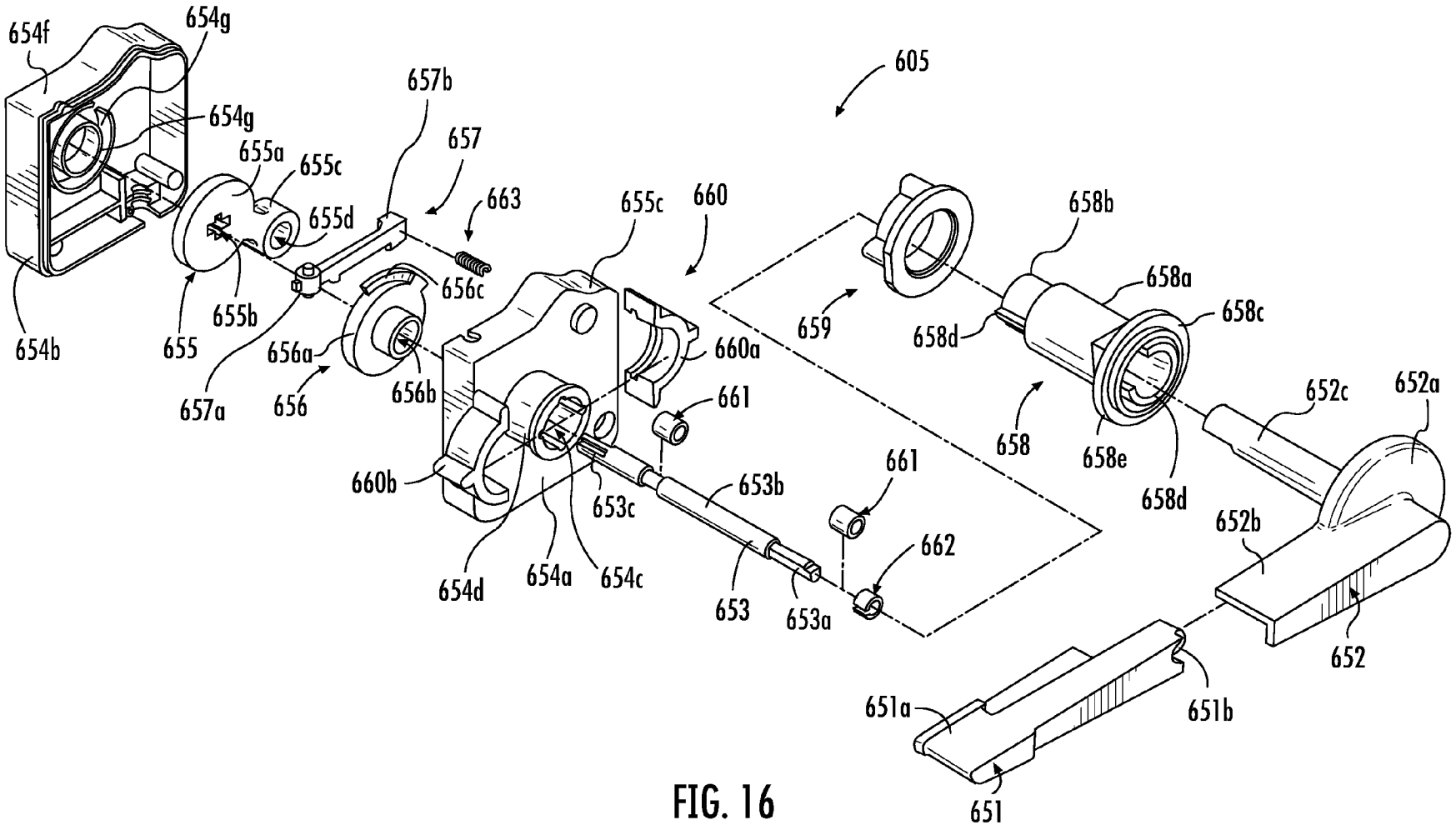
FIG. 16 is an exploded perspective view of another exemplary embodiment of a flush valve actuator.
Figure 18:
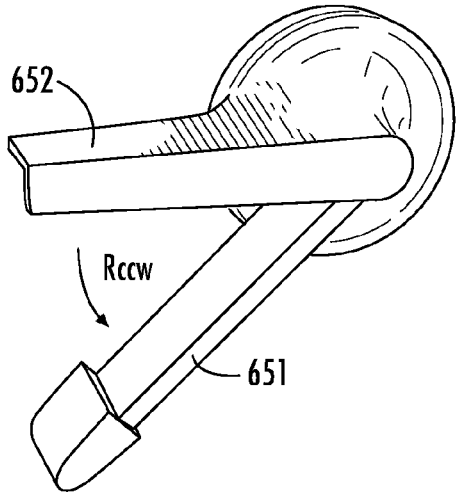
FIG. 18 is a perspective view of the handles of the flush valve actuator of FIG. 16 shown in the reduced flush mode of operation.

As shown, the housing 654 is configured to house components of the actuator assembly 605, such as the link arm 655, and may be configured to be disposed inside the tank 2, such as to improve the aesthetics of the tank 2. The housing 654 may include a first housing portion 654*a* and a second housing portion 654*b*, which may be integrally formed or formed separately then coupled together to define a cavity in which one or more than one component of the actuator assembly 605 may be housed therein. As shown in FIG. 16, the first housing portion 654*a* includes a generally rectangular body 654*c* having an open side and a cylindrical extension 654*d* that extends from a closed side of the body 654*c*. The cylindrical extension 654*d* includes an opening 654*e* that is configured to receive the shaft 653 therein, such that the shaft 653 may engage the link arm 655 and may rotate relative to the housing 654.

Also shown in FIG. 16, the second housing portion 654*b* includes a generally rectangular body 654*f* having an open side that mates with the open side of the first housing portion 654*a* to form the cavity. The second housing portion 654*b* may include a guide 654*g* or a plurality of guides 654*g* configured to support one or more components of the actuator assembly 605. For example, the second housing portion 654*b* may include a first guide 654*g* and a second guide 654*g*, where the first and second guides 654*g* are configured as annular projections, which are offset from each other by a gap or channel. The channel between the guides 654*g* may be configured to receive and support the link arm 655, while allowing the link arm 655 to rotate relative to the housing 654, such as when the link arm 655 is rotated by the shaft 653.

As shown, the first handle 651 is configured having an elongated wedge shape having a first end 651*a* and a second end 651*b*. The first end 651*a* of the first handle 651 is configured to be moved by a user to initiate one of the modes of operation of the flush valve, whereby the first handle 651 rotates about the second end 651*b* that is coupled to the shaft 653 in order to drive rotation of the shaft 653 with a corresponding amount of rotation relative to the first handle 651. In other words, the second end 651*b* of the first handle 651 is configured to transmit torque and drive rotation of the shaft 653 when the first handle 651 is rotated, such as by actuation of the first end 651*a*. For example, the second end 651*b* of the first handle 651 may be configured as an annular portion with a non-circular (e.g., square) hole disposed therein to act as a key-way feature that receives a similarly configured non-circular (e.g., square) section of the shaft 653 in order to transmit torque from the first handle 651 to the shaft 653. However, the first handle 651 may have any suitable configuration and may utilize any suitable method for transmitting torque and rotation to the shaft of the actuator assembly.

As shown, the second handle 652 is configured having a base 652*a*, an elongated L-shaped portion 652*b* that extends away from the base 652*a*, and a tubular portion 652*c* that extends away from the base 652*a*. The base 652*a* may be configured having a cap shape (e.g., having an annular wall that has a circular cover on one end and is open at the other end), or may have any suitable configuration. The base 652*a* may be configured to take the place of an escutcheon to improve the aesthetics of the actuator assembly 605. The L-shaped portion 652*b* of the second handle 652 may extend from the base in a radial direction or in any suitable direction, where the L-shaped portion is configured to nest with the elongated first handle 651, such as when both handles are positioned in the closed valve position. For example, the L-shaped portion 652*b* of the second handle 652 may overlap the first handle 651 when both handles are positioned in the closed valve position, such as to give the appearance of a unitary handle. The tubular portion 652*c* of the second handle 652 may extend from the base in an inward direction along the pivot axis of the handle, such as to engage another component of the actuator assembly 605. For example, the tubular portion 652*c* may engage a cam 656, if included in the actuator assembly 605. Accordingly, the tubular portion 652*c* may have a key-way feature (e.g., square shaped opening) that is configured to engage a mating key-way feature in the other component to transmit torque and drive rotation of the other component when the second handle 652 is rotated.

The shaft 653 is configured to transfer torque from a handle (e.g., the first handle 651) to the link arm 655. As shown, the shaft 653 communicates torque and rotation directly from the first handle 651 and indirectly from the second handle 652 (i.e., through contact between the first and second handles 651, 652). In other words, the shaft 653 communicates the rotation from the first and second handles 651, 652 to thereby rotate the link arm 655 accordingly. The shaft 653 includes a first end that is disposed toward the handles and a second opposing end that is disposed toward the link arm 655. The shaft 653 may include one or more engaging portions that are configured to engage another component to transmit torque and rotation to or from the engaged component. For example, the shaft 653 may include a first engaging portion 653*a*, a second engaging portion 653*b*, and a third engaging portion 653*c*. The first engaging portion 653*a* is configured to engage the first handle 651 to receive torque and rotation from the handle, such that rotation of the first handle 651 rotates the shaft 653. The second engaging portion 653*b*, if provided, may be configured to engage a bearing to allow for efficient rotation of the shaft 653 relative to another component, such as the second handle 652. The third engaging portion 653*c* of the shaft 653 is configured to engage the link arm 655 to transmit torque and rotation to the link arm 655, such as torque and rotation received from the first handle 651. The first engaging portion 653*a* and/or second engaging portion 653*b* may be disposed proximate to the first end, on the first end, near the first end, or anywhere along the shaft 653. The third engaging portion 653*c* may be disposed proximate to the second end, on the second end, near the second end, or anywhere along the shaft 653. Each engaging portion may be configured as a key-way feature (e.g., splined, square-shaped, fluted, gear-shaped, etc.) that is configured to engage with a mating key-way feature of the respective component (e.g., link arm, handle) to effectively transmit the torque and rotation.

Figure 17:
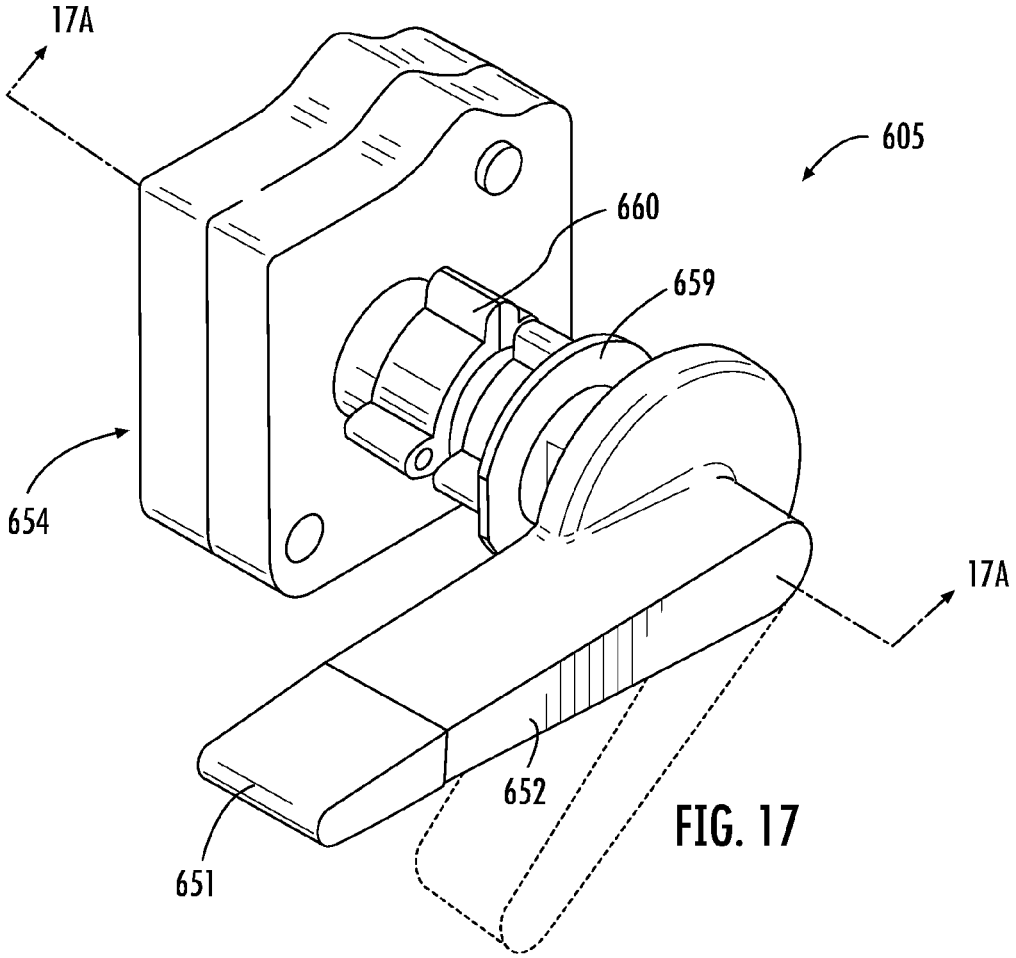
FIG. 17 is an assembled perspective view of the flush valve actuator of FIG. 16.
Figure 17A:
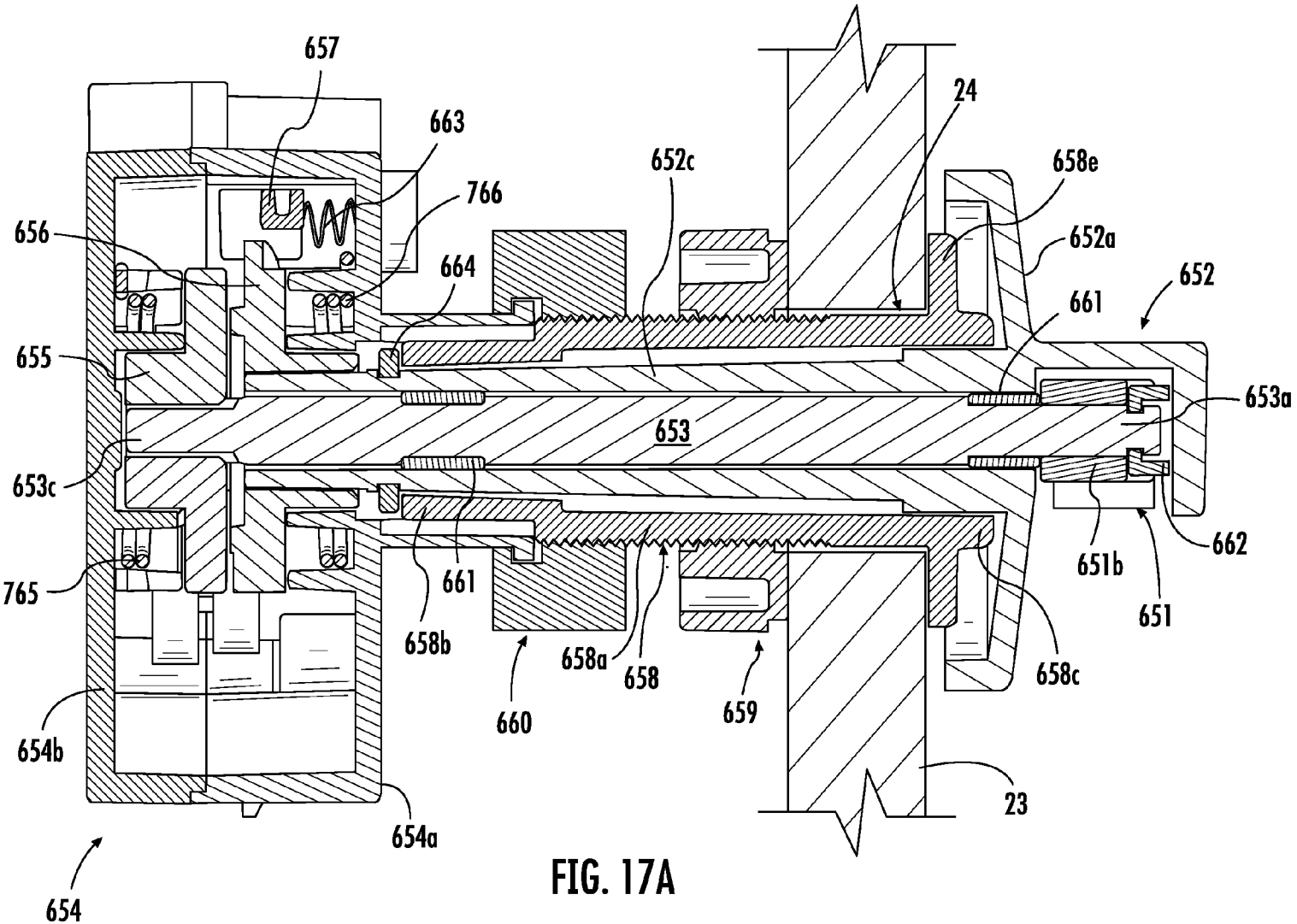
FIG. 17A is a cross-sectional view of the flush valve actuator of FIG. 17, taken along line 17A-17A.

It should be noted that the shaft 653 of the actuator assembly 605 does not need to include all of the engaging features. For example, as shown in FIG. 17A, the shaft 653 does not need to include the second engaging feature 653*b*, and the shaft 653 may be configured to rotate with respect to the second handle 652 and/or the bearing disposed therebetween. For the actuator assembly 605 having the second handle 652 configured to operatively rotate the first handle 651 when the second handle 652 is rotated, rotation of the second handle 652 is configured to drive rotation of the first handle 651 and an engaging feature is not needed between the shaft 653 and the second handle 652 (or between the shaft 653 and a bearing), since rotation of the second handle 652 indirectly rotates the shaft 653 through the first handle 651 and the first engaging feature 653*a*. Thus, the actuator assembly 605 may be configured to include a first engaging portion 653*a* and a third engaging portion 653*c*.

Figure 19:
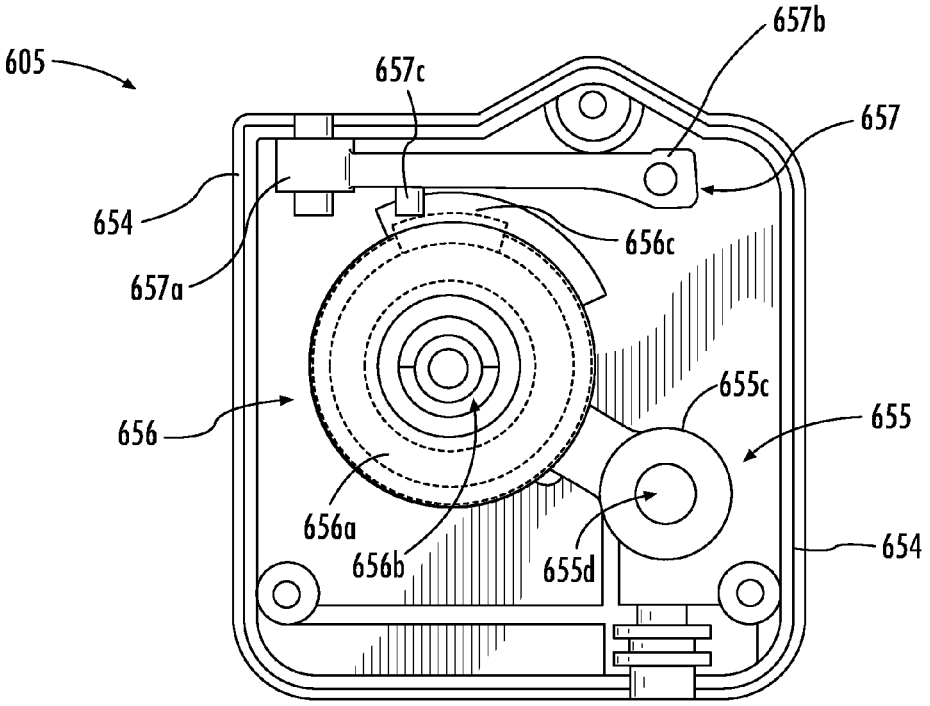
FIG. 19 is a front view of a portion of the flush valve actuator of FIG. 16 shown in the home position corresponding to a closed mode of operation of the flush valve.

As shown in FIG. 19, the link arm 655 is configured to rotate from a first position (e.g., non-activated position, home) when selectively rotated by the shaft 653, in order to actuate a flush cycle of the flush valve assembly. The link arm 655 is configured to rotate from the first position to one or more other positions to provide one or more flush modes of operation of the toilet. For example, the link arm 655 may be configured to rotate to a second position (e.g., reduced flush position) in order to activate the flush valve to operate in a first flush mode of operation, such as a reduced flush cycle. Further, the link arm 655 may also be configured to rotate beyond the second position to a third position (e.g., full flush position) in order to activate the flush valve to operate in a second flush mode of operation, such as a full flush cycle. A connecting member (not shown), such as a chain, may be coupled at one end to the flush valve assembly and coupled at the other end to the link arm 655, whereby rotation of the link arm 655 moves the connecting member to thereby move the flush valve between positions, such as from a closed position to an open position. The connecting member may engage the link arm 655 through an opening in the housing 654.

As shown, the link arm 655 has an annular body 655*a* with a central opening 655*b* that is configured to mate with the third engaging feature 653*c* of the shaft 653 in order for the link arm 655 to receive torque and rotation from the shaft 653. The link arm 655 may also include an arm 655*c* that extends away from the body 655*a*. The arm 655*c* may include a connecting feature 655*d* for coupling the connecting member (not shown) thereto, where the connecting member is configured to actuate the valve assembly to control the flush cycle of the toilet. The connecting feature 655*d* may be configured as an opening or an eyelet, such as to receive a chain, or may have any suitable configuration that allows a connecting or linking member to be coupled to the link arm 655. In other words, the link arm 655 may include a distal end provided on the arm 655*c*, where the distal end includes a feature 655*d* for attaching the connecting member thereto to control the flush cycle of the toilet.

The actuator assembly 605 may also include a cam 656 and a cam follower 657 to help control the flush mode of operation of the flush valve. The cam 656 and cam follower 657 may be disposed in the cavity of the housing 654 and may cooperate with the actuator assembly 605 to limit the rotational travel of the link arm 655 to thereby control the movement (e.g., stroke) of the arm 655*c* of the link arm 655 to a first position (e.g., reduced flush position), a second position (e.g., a full flush position), or any number of positions.

Figure 20:
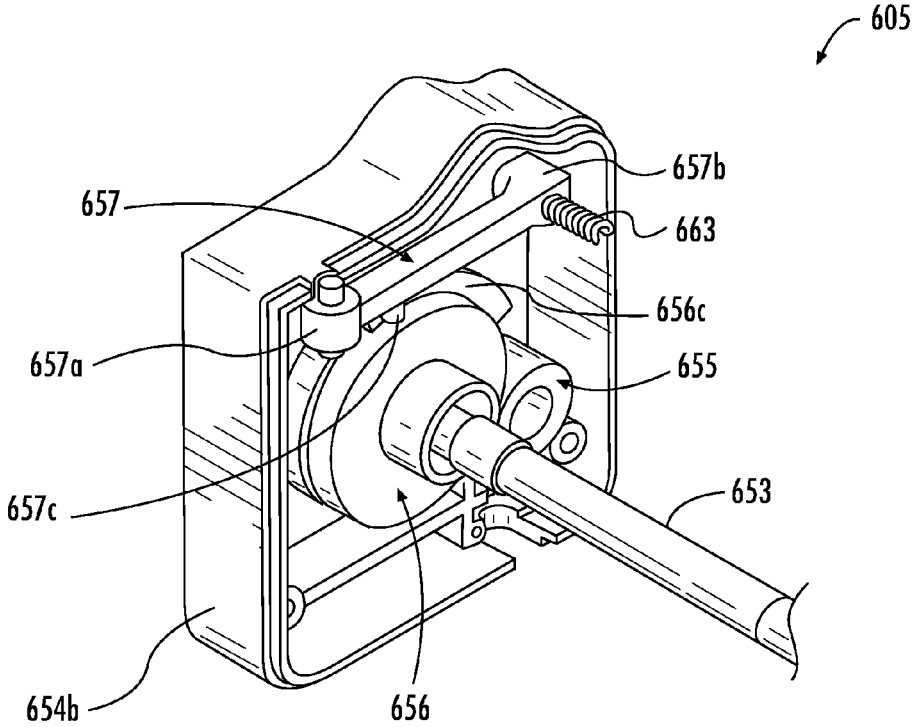
FIG. 20 is a perspective view of flush valve actuator of FIG. 19.

As shown, the cam 656 includes an annular body 656*a* that includes an opening 656*b* therein, where the opening is configured to receive another component to drive rotation of the cam 656 about a pivot axis defined by the opening 656*b*. As shown in FIG. 17A, the cam 656 is configured to directly receive the tubular portion 652*c* of the second handle 652, so that rotation of second handle 652 rotates the cam 656. It should be noted that the cam 656 may be driven by rotation of any other component(s) in the actuator assembly 605. The cam 656 includes a cam surface 656*c* that is configured to guide the cam follower 657. As shown in FIGS. 16 and 20, the cam surface 656*c* is configured as a ramp surface that is disposed along a portion of the outer edge of the cam 656, where the ramp surface is configured at an angle relative to the body 656*a* of the cam 656 and relative to a plane that is transverse to the pivot axis of the cam 656. However, the cam surface 656*c* may be configured having a straight ramp, a curved ramp, or a ramp having any suitable configuration. As shown, the cam surface 656*c* is configured to change the position of the cam follower 657 when the cam 656 is rotated.

Figure 21:
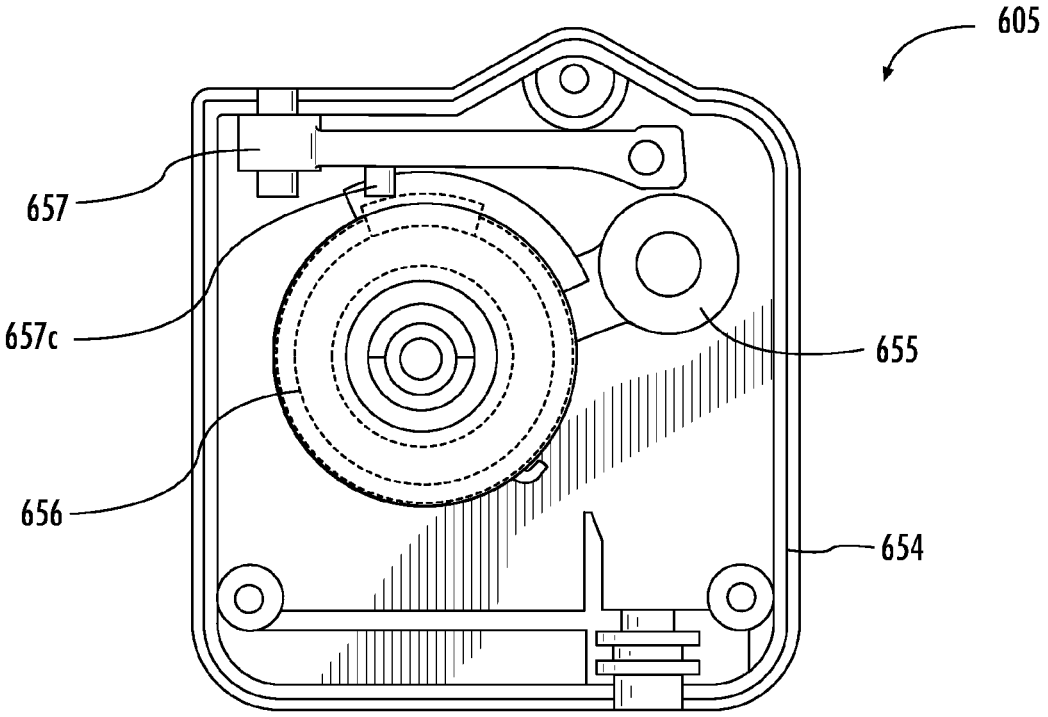
FIG. 21 is a front view of a portion of the flush valve actuator of FIG. 16 shown in the reduced flush position corresponding to a reduced flush mode of operation of the flush valve.
Figure 22:
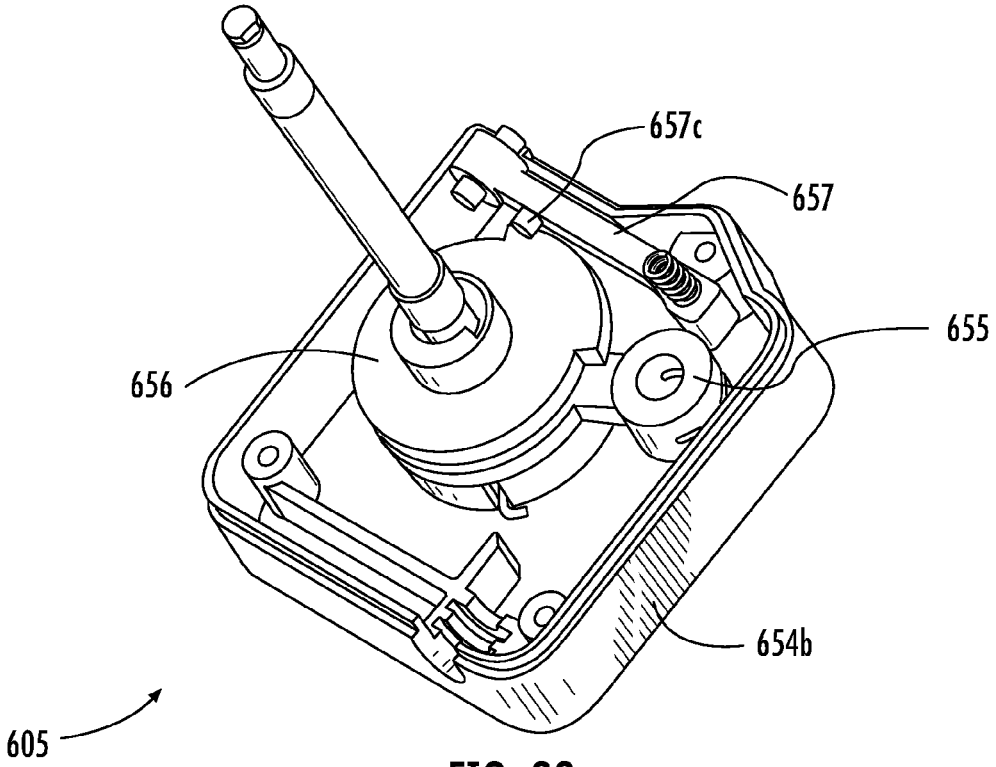
FIG. 22 is a perspective view of flush valve actuator of FIG. 21.
Figure 23:
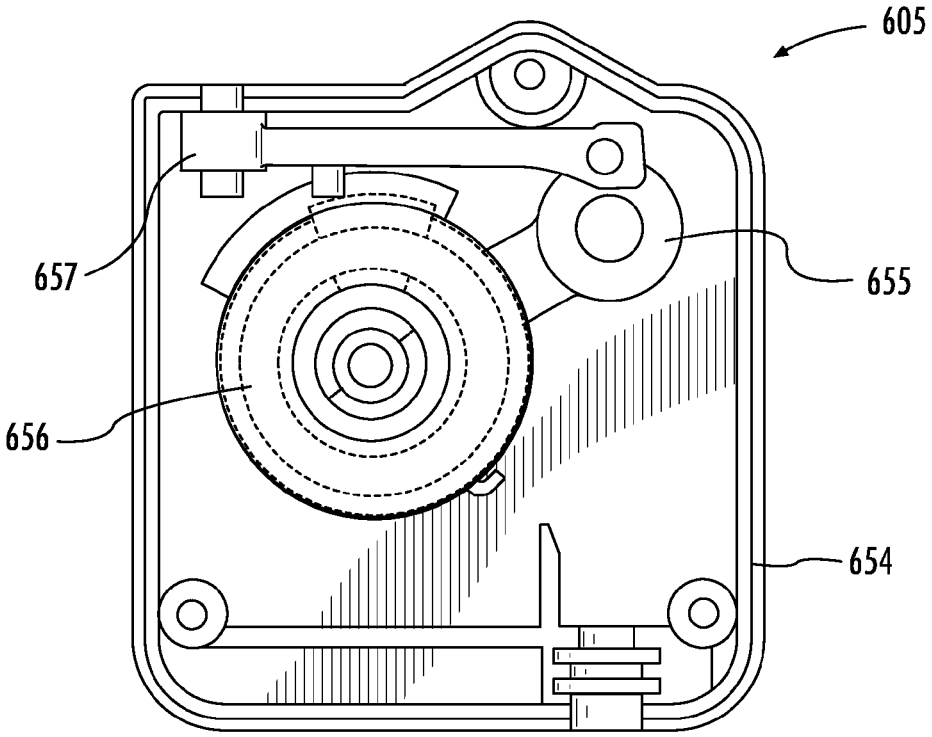
FIG. 23 is a front view of a portion of the flush valve actuator of FIG. 16 shown in the full flush position corresponding to a full flush mode of operation of the flush valve.
Figure 24:
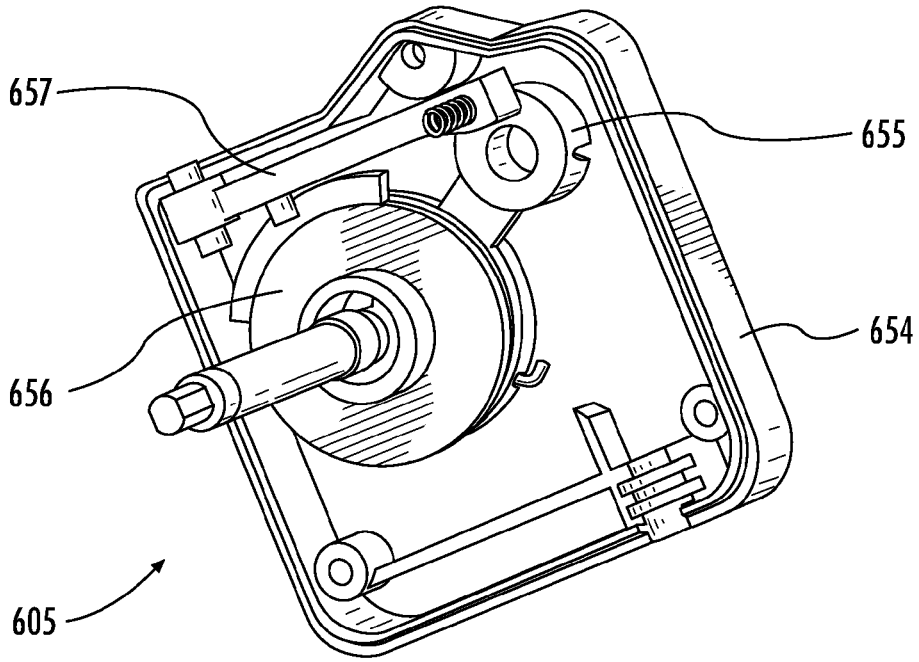
FIG. 24 is a perspective view of flush valve actuator of FIG. 23.

The cam follower 657 is configured to move between a first position and a second position. As shown in FIGS. 21 and 22, when in the first position, the cam follower 657 limits the movement (e.g., rotation) of the link arm 655, such as to provide a first (e.g., reduced) flush mode of operation of the flush valve. In other words, when the cam follower 657 is in its first position, the cam follower 657 prohibits the link arm 655 from rotating beyond its second position to actuate the flush valve to operate in a reduced flush cycle mode of operation. As shown in FIGS. 23 and 24, when in the second position, the cam follower 657 allows the link arm 655 to move (e.g., rotate) farther than when the cam follower 657 is in its first position. In other words, when the cam follower 657 is in its second position, the cam follower 657 allows the link arm 655 to rotate beyond its second position to the third position of the link arm 655 to actuate the flush valve to operate in a full flush cycle mode of operation.

As shown, the cam follower 657 is configured as an elongated member having a first end 657*a* and a second end 657*b*. The second end 657*b* of the cam follower 657 may be a distal end that is configured to pivot about the first end 657*a* to move the cam follower 657 between the first and second positions. The first end 657*a* may be configured as an annular member having two cylindrical projections that extend from opposing sides of the annular member to form a pivot that defines a pivot axis for the cam follower 657 to rotate about. For example, the cylindrical projections may engage the housing 654, such that the cam follower 657 is able to rotate relative to the housing 654. Alternatively, the first end 657*a* may be configured as an annular member having a central hole that is configured to receive a pin that defines the pivot axis, or may have any suitable configuration that permits the cam follower 657 to rotate. Although, the pivot axis of the cam follower 657 is shown to extend in a direction that is transverse (e.g., in a vertical direction) to the pivot axis of the link arm 655, the actuator assembly 605 (e.g., the cam follower 657) may be configured differently than shown herein and still control the amount of movement (e.g., rotation) that the link arm 655 is able to rotate.

The second distal end 657*b* of the cam follower 657 may have a polygonal shape or may be configured to have any suitable shape, and is disposed in the path of rotation of the link arm 655 when the cam follower 657 is in the first position. When the cam follower 657 is moved to the second position the second end 657*b* is moved out of the path of rotation of the link arm 655. In other words, the second end 657*b* of the cam follower 657 is configured to move between a first position that is in the plane of rotation of the link arm 655, such as to limit the rotation of the link arm 655, and a second position that is out of the plane of rotation of the link arm 655, such as not to limit the rotation of the link arm 655. The second end 657*b* may include a feature, such as a recess or counterbore, that is configured to receive a biasing member to bias the cam follower 657 into the first position. As shown, the biasing member 663 is configured as an extension spring, where one end of the spring 663 is disposed in the counterbore in the second end 657*b* of the cam follower 657. When the cam follower 657 is moved from the first position to the second position, the spring 663 is compressed to store energy, whereby once the force acting on the cam follower 657 is released, the spring 663 releases the stored energy to move the cam follower 657 from the second position toward the first position.

The cam 656 is configured to guide the movement of the cam follower 657 between the first position and the second position of the cam follower 657. As shown in FIG. 19-24, the cam follower 657 includes a guide member 657*c* that is configured to engage the cam 656, such as the cam surface 656*c*, where the cam surface 656*c* guides or controls the movement of the cam follower 657 through the guide member 657*c*. Accordingly, the cam surface 656*c* of the cam 656 guides the guide member 657*c* to control the position of the cam follower 657. For example, as the cam 656 is rotated, the guide member 657*c* is moved along the ramp surface of the cam surface 656*c*, where the ramp moves the guide member 657*c* to pivot the cam follower 657 about the pivot axis of the first end 657*a* such that the second end 657*b* then is moved out of the plane of rotation of the link arm 655.

The actuator assembly 605 may also include a trip lever bushing 658, a trip lever nut 659, and a first retainer 660 (e.g., split ring retaining clip), which may help couple the actuator assembly 605 to the toilet, such as to the front wall 23 of the tank 2. As shown in FIG. 17A, the busing 658 is configured to engage the opening 24 in the front wall 23 of the tank 2, where then the trip lever nut 659 may be coupled to the bushing 658 in order to secure the bushing 658 (and nut 659) to the tank 2. The first retainer 660 may then be used to secure the housing (along with the other components in the housing) to the bushing 658, after assembly of the other components of the actuator assembly (e.g., handles, shaft).

As shown, the bushing 658 includes an annular or tubular body 658*a* that extends between a first end 658*b* and a second end 658*c*. The first end 658*b* is configured to engage and/or be coupled to the housing 654, and may include a feature that is configured to engage a mating feature in the housing 654 to maintain a predetermined orientation between the bushing 658 and the housing 654. In other words, the bushing 658 and the housing 654 may be configured to have a preset alignment that is ensured by the features, and the features may further prevent relative rotation between the bushing 658 and housing 654 once assembled. As shown in FIG. 16, the first end 658*b* of the bushing 658 includes a projection 658*d* that is configured to engage a recess or channel that is defined by the opening 654*e* in the extension 654*d* of the housing 654.

The second end 658*c* of the bushing 658 may include an annular shoulder 658*e* that extends outwardly from the body 658*a*, such as perpendicular to the body 658*a*, where the shoulder 658*e* is configured to abut the tank 2 when securing the actuator assembly 605, such as the bushing 658, to the tank 2. As shown in FIG. 17A, the inside surface of the shoulder 658*e* is configured to abut or contact the outside surface of the front wall 23 of the tank 2 to provide a clamp surface, such as when the nut 659 is coupled to the bushing 658 to secure the actuator assembly in place relative to the tank 2. The shoulder 658*e* may be configured to have any suitable size and shape, which may be differently than shown, and still provide the clamp surface for attaching the actuator assembly 605 to the tank 2. As shown, the shoulder 658*e* is configured not to extend beyond the body 652*a* of the second handle 652, such as to be hidden from view by the body 652*a* acting as an escutcheon. The second end 658*c* of the bushing 658 may also include a feature that is configured to limit the rotation of a handle of the toilet, such as to prevent an overloading condition through the actuator assembly (e.g., the link arm), if the handle is over-loaded. For example, the second end 658*c* may include an annular projection 658*f* that extends forward (i.e., in a direction along the pivot axis of the shaft 653 away from the housing 654), where the projection 658*f* is discontinuous (e.g., having a semi-circular cross section). The handle may have a feature that is disposed in the discontinuous portion of the bushing 658, such that the ends of the continuous portion(s) of the projection 658*f* may serve as rotational travel stops for the handle as the feature of the handle may engage the ends of the bushing 658.

The body 658*a* of the bushing 658 may be configured to be coupled to the nut 659, such as to secure the actuator assembly to the tank 2. As shown in FIG. 17A, the body 658*a* includes exterior threads that are configured to thread to internal threads of the nut 659 to secure the actuator assembly in place relative to the front wall 23. However, the bushing 658 may be configured differently and still be configured to be coupled to the nut 659, and the embodiments disclosed herein are examples and are not limiting. As shown, the nut 659 may thread onto the bushing 658 from inside the tank 2 to facilitate coupling the housing 654 to the bushing 658, such as with the retainer 660.

The actuator assembly 605 may also include a bearing 661 to help provide efficient rotation of a component, such as the shaft 653, relative to a second component of the actuator assembly 605. As shown, the actuator assembly 605 includes two bearings 661 disposed at different locations along the shaft 653 to allow for efficient rotation of the shaft 653 relative to the tubular portion 652*c* of the second handle 652, since the shaft 653 may rotate relative to the second handle 652, such as when the first handle 651 is rotated.

The actuator assembly 605 may also include a second retainer 662 that is configured to secure and retain the first handle 651 to the shaft 653. As shown, the end of the shaft 653 may include a recess or undercut section that is configured to receive the second retainer 662. The second retainer 662 may be configured as a snap-ring or any suitable device that connects to the shaft 653. The actuator assembly 605 may also include other retaining members. For example, the actuator assembly 605 may include a third retainer 664 that is configured to engage the tubular portion 652*c* of the second handle 652 at a location that is inside the first end 658*b* of the bushing 658. The third retainer 664 may prevent the second handle 652 from moving (along the axis of rotation of the shaft 653) relative to the bushing 658 to a location where the second handle 652 becomes decoupled from the bushing 658.

According to an exemplary method of assembly, the actuator assembly 605 may be configured using a five step process of assembly. The first step involves assembling the link arm 655, cam follower 657, cam 656, and spring(s) (e.g., spring 663) into the housing 654. The second step involves securing the bushing 658 to the front wall 23 of the tank 2 by inserting the bushing through the opening 24, then coupling, such as through a threaded engagement, the nut 659 to the bushing 658 to clamp the tank 2 between the nut 659 and bushing 658. The third step involves attaching the first handle 651 to the shaft 653, then securing them together with the retainer 662. The bearings 661, if used, may be attached to the shaft 653 before or during assembly. The fourth step involves attaching the second handle 652 to the coupled shaft 653 and first handle 651, which together may then be inserted into the bushing 658. The retainer 664, if used, may then be attached to second handle 652 to secure it (as well as the first handle 651 and the shaft 653) to the bushing 658. The fifth step involves connecting the housing to the bushing 658 through the retainer 660 from inside the tank after operatively connecting the shaft 653 to the link arm 655. Once the bushing 658 and housing 654 are in the correct relative locations, such as shown in FIG. 17A, the retainer 660 may be used to secure the housing 654 and the bushing 658. For example, the inside surface of the retainer 660 may have a recess or channel that is configured to receive a tab or extension from the housing 654 to couple the retainer 660 and the housing 654, and the retainer 660 may also include a threaded portion (e.g., internal threaded portion) that is then threaded to external threads along the bushing 658 to secure the retainer 660 to the bushing 658. However, the retainer 660 may be configured differently, such as, for example, by having threads that are configured to thread to mating threads on both the housing 654 (e.g., along the exterior of the extension 654*d*) and the bushing 658, or may have any suitable configuration.

Figure 25:
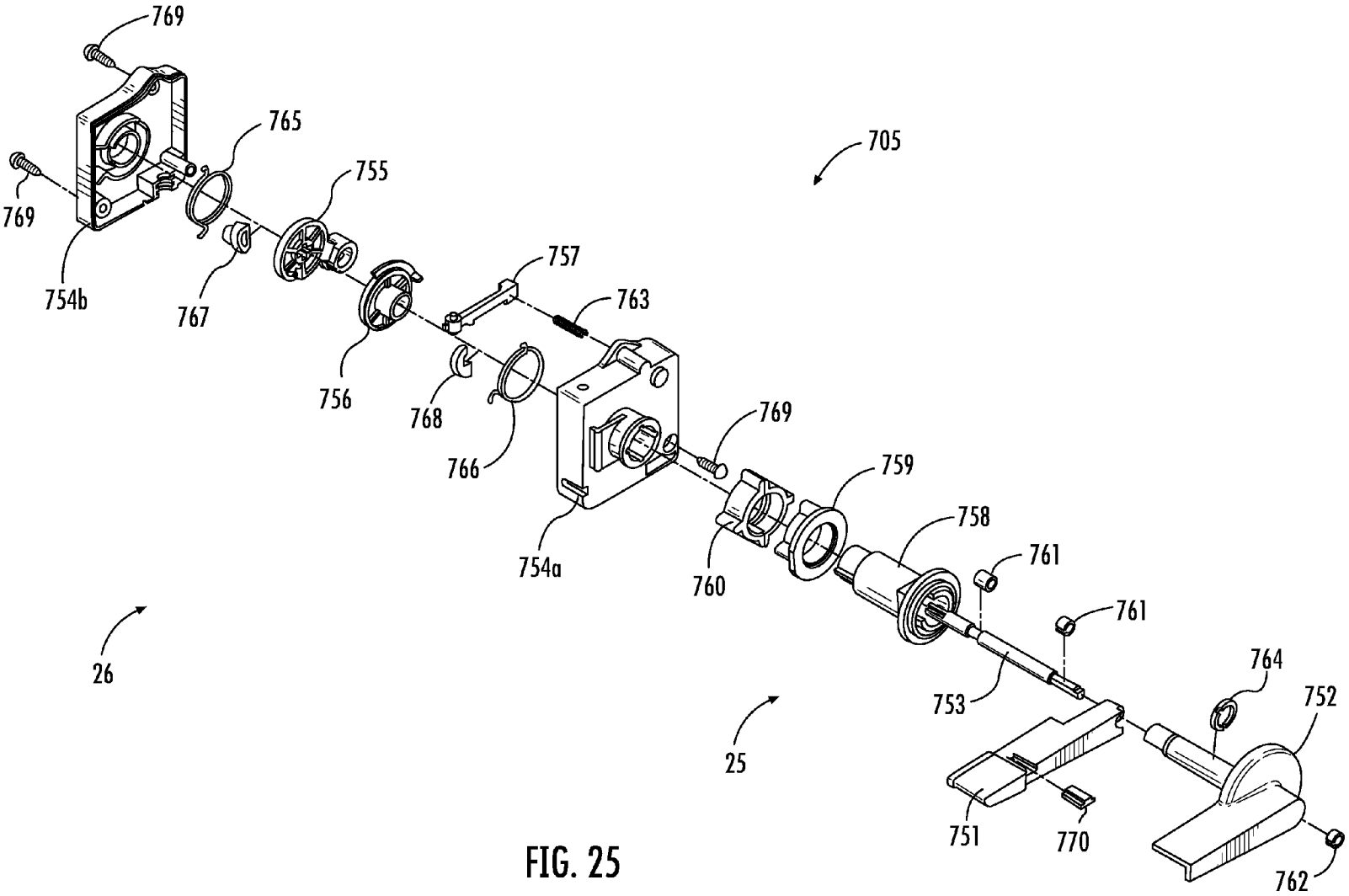
FIG. 25 is an exploded perspective view of yet another exemplary embodiment of a flush valve actuator.
Figure 26:
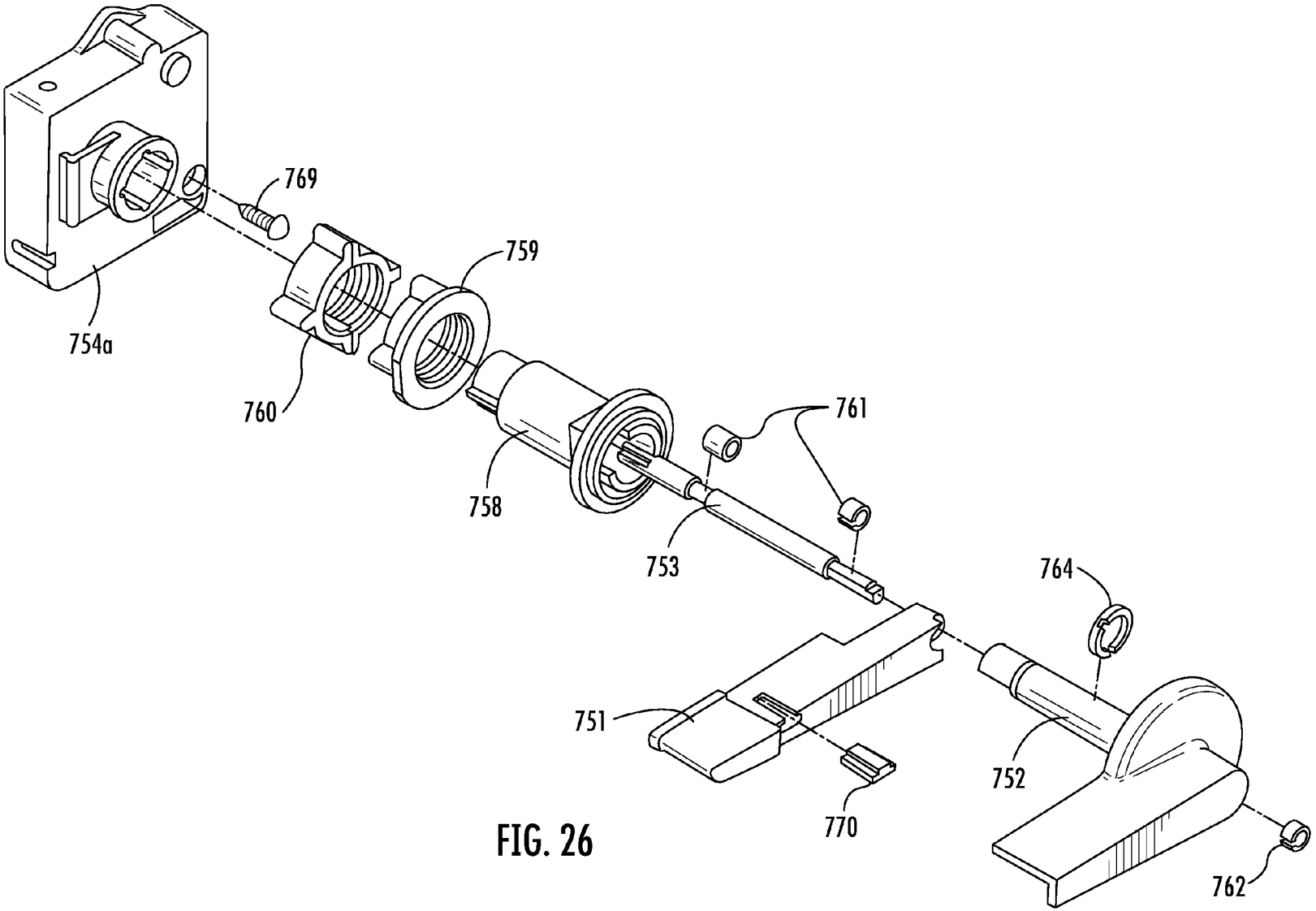
FIGS. 26 and 27 are exploded perspective views of portions of the flush valve actuator of FIG. 25.
Figure 27:
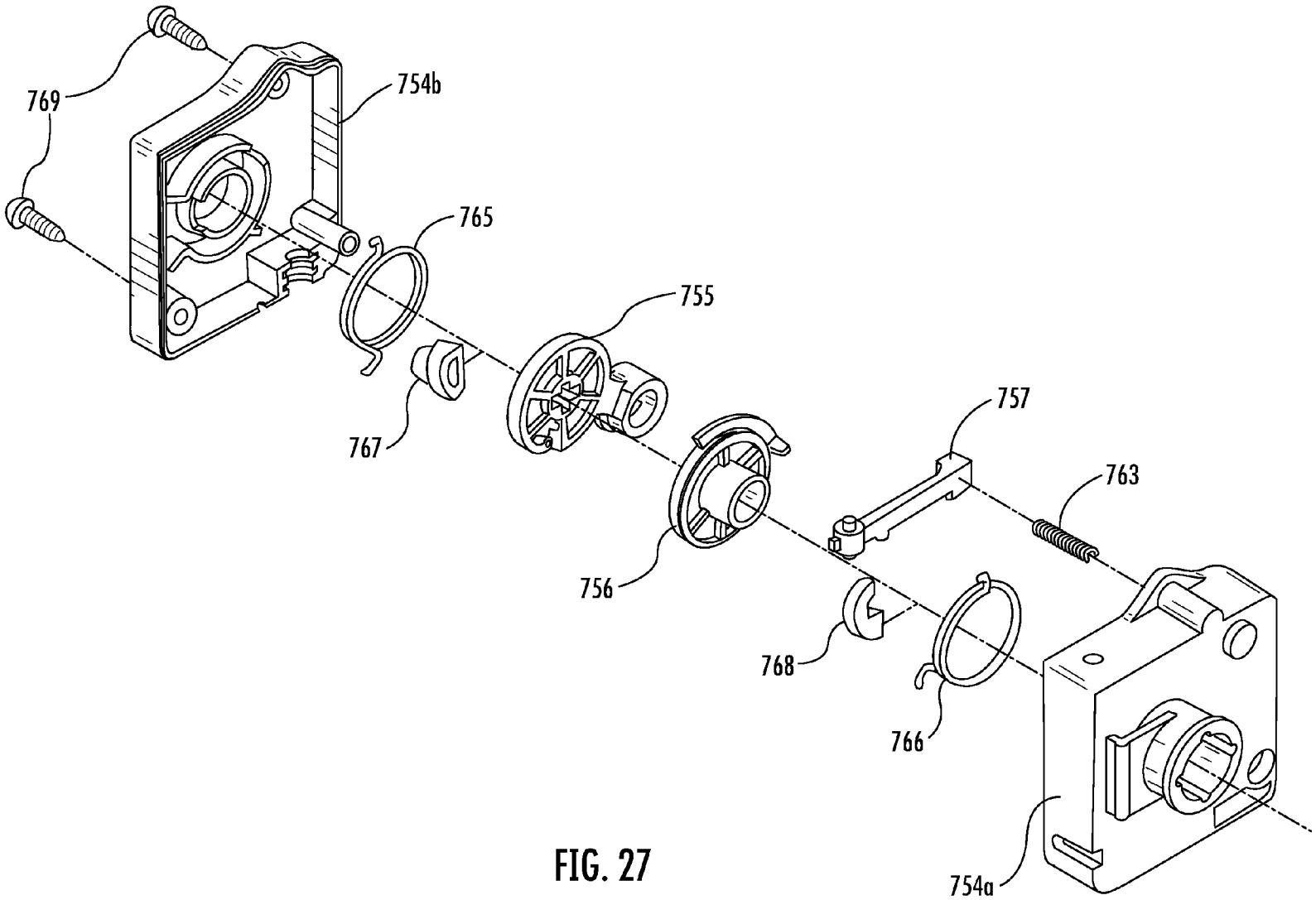

FIGS. 25-27 illustrate another exemplary embodiment of an actuator assembly 705 that is configured to control the actuation of the flush valve assembly. The actuator assembly 705 may be configured generally as described for the actuator assembly 605 shown in FIGS. 16-24, yet may include at least the differences described below. In other words, the actuator assembly 705 may include one, a combination, or all of the following components; a first handle 751, a second handle 752, a shaft 753, a housing 754, a link arm 755, a cam 756, a cam follower 757, a bushing 758, a nut 759, a retainer 760, a bearing 761, a second retainer 762, a biasing member 763, a third retainer 764, each of which may be generally configured as described above.

The actuator assembly 705 may also include a second biasing member 765 that is configured to bias the rotation of the link arm 755, such as in a direction toward the first position of the link arm 755, which corresponds to a closed flush valve mode of operation. The second biasing member 765 may be configured as a spring, such as a torsion spring, that includes a first end that is configured to engage the link arm 755 and a second end that is configured to engage another component of the assembly 705, such as the housing 754. Rotation of the link arm 755 from its first position toward its second (and third) position(s) is configured to wind the spring 765 in order to store energy therein, such that when the rotational force is release from the link arm 755, the spring 765 biases the link arm 755 back toward its first position. The spring 765 may be configured to fit within one or more guides of the housing 754 to maintain its general position. The actuator assembly 705 may also include another feature to retain the second biasing member 765 in place. For example, the actuator assembly 705 may include a clip 767 that is used to retain the second biasing member 765 in the housing 754.

The actuator assembly may also include a third biasing member 766 that is configured to bias the rotation of the cam 756, such as in a direction toward the first position of the cam 756, which corresponds to a closed flush valve mode of operation. The third biasing member 766 may be configured as a spring, such as a torsion spring that includes a first end that is configured to engage the cam 756 and a second end that is configured to engage another component of the assembly 705, such as the housing 754. Rotation of the cam 756 away from its first position is configured to wind the spring 765 to store energy which is used to bias the cam 756 back toward its first position, when the rotational force is released on the cam 756. The spring 766 may be held in place by the housing, such as by one or more guides of the housing 754, or by another feature, such as a clip 768, to hold the spring 766 in place.

The actuator assembly may also include a bumper 770 that is configured to dampen the contact between the first handle 751 and the second handle 752. The bumper 770 may be made from an elastomeric material or any other suitable material, and may be disposed between the first handle 751 and the second handle 752, such that when the handles are brought into proximity, the bumper 770 makes contact with the handles. For example, the bumper 770 may be configured to be coupled to the first handle 751, such that when the second handle 752 is moved from a separated position relative to the first handle 751 to a position that is proximate the first handle 751, the second handle 752 may make contact with the bumper 770 before the first handle 751. The bumper 770 may delay contact between the handles, such as to reduce the energy, or may prohibit contact between the handles. Accordingly, if the handles are made from a material, such as metal, that might be prone to induce a noise upon contact of the handles, the bumper may eliminate any such noise. As shown in FIG. 26, the bumper 770 is configured having a T-shape, such that the bumper 770 may slide into a recess or pocket provided in the first handle 751. The bumper 770 may be configured to compress to fit into the pocket of the first handle 751 to retain the bumper 770 in place.

In operation of an actuator assembly that is configured to provide a first reduced flush cycle of a flush valve of a toilet and a second full flush cycle, the actuator assembly may include a first handle, a second handle, a link arm that is configured to rotate, and a shaft configured to transmit torque from the first handle to the link arm. The link arm may be configured to rotate from a first position to a second position to drive operation of the flush valve through a linking member from a closed position to a first reduced open position, and may be configured to rotate from a closed position to a third full open position. Rotation of the first handle alone is configured to rotate the link arm to the second position to effect a reduced flush cycle of the flush valve, and rotation of the second handle drives rotation of the first handle to rotate the link arm to the third position to effect a full flush cycle of the flush valve.

The actuator assembly may further include a cam follower and a cam that is configured to be rotate by the second handle, where the cam follower is configured to be moved between a first position and a second position by rotation of the cam. In the first position, the cam follower limits the rotation of the link arm to the second position of the link arm, and in the second position, the cam follower allows the link arm to rotate to the third position of the link arm.

The link arm of the actuator assembly may be configured to move the linking member, which may interconnect the actuator assembly to the flush valve to allow the actuator assembly to control operation of the flush valve. The linking member may be a chain, an arm, or any suitable member that is configured to transfer movement from a first device (e.g., the link arm) to a second device (e.g., the flush valve). Further, the flush valve may be configured as a canister valve, such that the linking member moves a float, valve body, or any other suitable device to change modes of operation (e.g., closed, reduced open, full open) of the flush valve. Alternatively, the flush valve may be configured as a flapper valve, having a flap that is configured to pivot from a closed position to an open (e.g., reduced, full) position, or the flush valve may have any suitable configuration to control the volume of water that is transferred during a flush cycle (e.g. reduced, full) from the tank to the bowl of the toilet.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the multi-flush toilets having flush valve systems and actuation mechanisms as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An actuation mechanism for a dual flush toilet assembly, the actuation mechanism comprising:

a first handle configured to be mounted to a first side of a toilet tank;

a second handle mounted coaxially relative to the first handle and configured to be mounted to the first side of the toilet tank;

a housing configured to be mounted to a second side of the toilet tank;

a link arm member provided within the housing and pivotally coupled to the first and second handles; and a moveable stop member provided within the housing;

wherein rotation of one of the first handle and the second handle results in rotation of the link arm member being limited by the moveable stop member such that the link arm member is permitted to rotate a first amount to provide a partial flush for the toilet assembly; and wherein rotation of both the first handle and the second handle results in movement of the moveable stop member such that the link arm member is permitted to rotate a second amount greater than the first amount to provide a full flush for the toilet assembly.

2. The actuation mechanism of claim 1, wherein the link arm member includes a first link arm member coupled to the second handle and a second link arm member coupled to the first handle, and wherein the first and second link arm members are mounted coaxially.

3. The actuation mechanism of claim 2, further comprising a drive member configured to move the stop member upon rotation of the second handle, and wherein rotation of only the first handle results in rotation of only the second link arm member.

4. The actuation mechanism of claim 3, wherein the drive member includes a first end pivotally coupled to the first link arm member and a second end pivotally coupled to the stop member.

5. The actuation mechanism of claim 4, wherein the stop member rotates about a pivot axis that is offset from and substantially parallel to a pivot axis of the handles.

6. The actuation mechanism of claim 1, further comprising a cam configured to move the stop member upon rotation of the second handle, and wherein rotation of only the first handle results in rotation of the link arm member without rotating the cam.

7. The actuation mechanism of claim 6, wherein the cam is provided coaxially with the second handle and driven to rotation about a pivot axis of the second handle by rotation of the second handle.

8. The actuation mechanism of claim 7, wherein the cam includes a cam surface that is disposed along a portion of an outer edge of the cam.

9. The actuation mechanism of claim 7, wherein the cam is configured to rotate between a first position and a second position, wherein when the cam is in the first position, the stop member limits the rotation of the link arm by the first amount, and wherein when the cam is in the second position, the stop member permits the link arm to rotate by the second amount.

10. The actuation mechanism of claim 9, further comprising a biasing member that biases the stop member from a second position, which permits the link arm to rotate by the second amount, to a first position, which limits the rotation of the link arm by the first amount.

11. An actuation mechanism for a multi-flush toilet assembly, the actuation mechanism comprising:

a first handle configured to pivot about a pivot axis;

a second handle configured to pivot about the pivot axis;

a moveable element; and a cam coupled to one of the first and second handles and including a cam surface configured to move the moveable element; and wherein rotation of the one of the first and second handles is limited to a first angular travel by the moveable element provided in a first position, the first angular travel configured to provide a first flush mode of the toilet assembly; and wherein rotation of both the first and second handles results in movement of the moveable element to a second position which permits the first and second handles to rotate to a second angular travel to provide a second flush mode that is different than the first flush mode.

12. The actuation mechanism of claim 11, further comprising a guide member configured to be fixedly mounted relative to the handles, the guide member having a cavity and a slot extending from the cavity.

13. The actuation mechanism of claim 12, wherein the cam is pivotally disposed in the guide member and configured to move the moveable element.

14. The actuation mechanism of claim 13, wherein when in the first position, the moveable element is in the slot, and wherein when in the second position, the moveable element is in the cavity.

15. The actuation mechanism of claim 14, wherein the moveable element is configured as ball.

16. The actuation mechanism of claim 13, wherein the cam is bi-planar including a first side and a second side, and the moveable element includes a first elongated portion configured to be driven by the first side and a second cylindrical portion configured to be driven by the second side.

17. The actuation mechanism of claim 11, wherein the cam is coupled to the second handle through a first member having a bore configured to receive a portion of a second member, and wherein the second member is coupled to the first handle.

18. The actuation mechanism of claim 17, wherein the cam includes a cam surface configured to drive movement of the moveable element upon rotation of the second handle, and wherein the movement of the moveable element is a rotational movement about a rotational axis of the moveable element.

19. An actuation mechanism for a multi-flush toilet, the actuation mechanism comprising:

a first handle configured to pivot about a pivot axis;

a second handle configured to pivot about the pivot axis;

a stop member configured to pivot between a first position and a second position; and a driving member configured to move the stop member;

wherein pivoting of only the first handle is limited to a first rotation by the stop member configured in the first position;

wherein pivoting of the second handle rotates the first handle with the second handle and moves the stop member to the second position through the driving member allowing the first and second handles to pivot to a second rotation that is greater than the first rotation;

wherein when the first handle is pivoted by the first rotation, the actuation mechanism actuates a first flush cycle of the toilet that is configured to transfer a first volume of water from a tank to a bowl; and wherein when both of the handles are pivoted by the second rotation, the actuation mechanism actuates a second flush cycle that is configured to transfer a second volume of water from the tank to the bowl, the second volume being greater than the first volume.

20. The actuation mechanism of claim 19, wherein the driving member is a cam that is configured to rotate about the pivot axis, the cam including a cam surface that is configured to rotate the stop member between the first and second positions about a rotational axis that extends parallel to the pivot axis.

* * * * *